US008013263B2

(12) United States Patent
Lindsey

(10) Patent No.: US 8,013,263 B2
(45) Date of Patent: Sep. 6, 2011

(54) MULTI-DECK TRANSFORMER SWITCH

(75) Inventor: Kurt Lawrence Lindsey, West Allis, WI (US)

(73) Assignee: Cooper Technologies Company, Houston, TX (US)

( * ) Notice: Subject to any disclaimer, the term of this patent is extended or adjusted under 35 U.S.C. 154(b) by 154 days.

(21) Appl. No.: 12/477,193

(22) Filed: Jun. 3, 2009

(65) Prior Publication Data

US 2010/0038222 A1 Feb. 18, 2010

Related U.S. Application Data

(63) Continuation-in-part of application No. 12/191,750, filed on Aug. 14, 2008, now Pat. No. 7,872,203.

(51) Int. Cl.
*H01H 19/00* (2006.01)

(52) U.S. Cl. ..... 200/11 TC

(58) Field of Classification Search ..... 200/11 TC, 200/336, 275, 61.54, 504, 11 G; 218/147; 333/107, 262

See application file for complete search history.

(56) References Cited

U.S. PATENT DOCUMENTS

| | | | |
|---|---|---|---|
| 1,943,011 | A | 1/1934 | Fryar |
| RE21,527 | E | 8/1940 | Smulski |
| 2,411,351 | A | 11/1946 | Armstrong |
| 2,466,072 | A | 4/1949 | Batcheller |
| 2,523,370 | A | 9/1950 | Jeffrey |
| 2,540,294 | A | 2/1951 | Schleicher |
| 2,558,412 | A | 6/1951 | Baldwin |
| 2,591,017 | A | 4/1952 | Schultz |
| 2,858,384 | A | 10/1958 | Taylor et al. |
| 2,990,878 | A | 7/1961 | Larsen |
| 3,246,100 | A | 4/1966 | Russell |
| 3,272,945 | A | 9/1966 | Flook |
| 3,289,131 | A | 11/1966 | Watkins et al. |
| 3,316,367 | A | 4/1967 | Kowalski |
| 3,430,170 | A | 2/1969 | Shantas et al. |
| 3,451,055 | A | 6/1969 | Pihl |

(Continued)

FOREIGN PATENT DOCUMENTS

CN 1698150 A 11/2005

(Continued)

OTHER PUBLICATIONS

Cooper Power Systems, OEM Equipment, Four-Position Sectionalizing Loadbreak Switches, Electrical Apparatus 800-64, Dec. 2003 (8 pages).

(Continued)

*Primary Examiner* — Edwin A. Leon
(74) *Attorney, Agent, or Firm* — King & Spalding LLP

(57) ABSTRACT

A transformer switch, such as a multi-deck tap changer, includes an assembly with a first housing coupled to a first cover. The first cover holds at least a first stationary electric contact. A second housing is formed integrally with the first cover, and is coupled to a second cover, the second cover holding at least a second stationary electric contact. The first housing and first cover together define a first interior volume within which the first stationary electric contact is disposed. The second cover and the second housing together define a second interior volume within which the second stationary electric contact is disposed. Each housing-cover coupled pair includes an interior rotor rotatable relative to the stationary electric contact in the cover of the pair. At least one movable contact is coupled to each rotor. The covers and housings can be molded from a non-conductive plastic.

20 Claims, 35 Drawing Sheets

U.S. PATENT DOCUMENTS

| | | | | |
|---|---|---|---|---|
| 3,582,856 | A | | 6/1971 | Watrous |
| 3,590,183 | A | | 6/1971 | Leonard |
| 3,634,857 | A | | 1/1972 | Pihl |
| 3,715,543 | A | * | 2/1973 | Keto et al. ..... 218/117 |
| 3,789,172 | A | | 1/1974 | Cole et al. |
| 3,940,584 | A | | 2/1976 | Cauldwell et al. |
| 3,944,772 | A | | 3/1976 | Davies |
| 4,032,870 | A | | 6/1977 | Oppel et al. |
| 4,080,582 | A | | 3/1978 | Link |
| 4,132,986 | A | | 1/1979 | Hart et al. |
| 4,226,211 | A | | 10/1980 | Barrentine |
| 4,234,847 | A | | 11/1980 | Schweitzer |
| 4,245,140 | A | | 1/1981 | Jencks et al. |
| 4,262,216 | A | | 4/1981 | Johnston |
| 4,268,890 | A | | 5/1981 | Silbermann |
| 4,288,769 | A | | 9/1981 | Howell |
| 4,383,231 | A | | 5/1983 | Yamanaka et al. |
| 4,412,116 | A | | 10/1983 | Golub |
| 4,424,512 | A | | 1/1984 | Schweitzer, Jr. |
| 4,427,860 | A | | 1/1984 | Eley |
| 4,435,690 | A | | 3/1984 | Link et al. |
| 4,438,403 | A | | 3/1984 | Schweitzer, Jr. |
| 4,532,386 | A | | 7/1985 | Muench, Jr. et al. |
| 4,533,797 | A | | 8/1985 | Kranich, II et al. |
| 4,550,298 | A | | 10/1985 | Mikulecky |
| 4,554,420 | A | | 11/1985 | Golub |
| 4,591,816 | A | | 5/1986 | Mikulecky et al. |
| 4,611,189 | A | | 9/1986 | Mikulecky |
| 4,737,878 | A | | 4/1988 | Mikulecky |
| 4,795,982 | A | | 1/1989 | Schweitzer, Jr. |
| 4,873,706 | A | | 10/1989 | Schweitzer, Jr. |
| 5,021,615 | A | * | 6/1991 | Muench et al. ..... 200/11 TC |
| 5,070,252 | A | | 12/1991 | Castenschiold et al. |
| 5,220,311 | A | | 6/1993 | Schweitzer, Jr. |
| 5,252,933 | A | | 10/1993 | Kamino et al. |
| 5,278,530 | A | | 1/1994 | Zovath |
| 5,351,024 | A | | 9/1994 | Juds et al. |
| 5,552,647 | A | | 9/1996 | Tinkham |
| 5,726,621 | A | | 3/1998 | Whitney et al. |
| 5,925,405 | A | | 7/1999 | Ali-Khan |
| 6,037,555 | A | | 3/2000 | Castonguay et al. |
| 6,069,331 | A | | 5/2000 | Utke |
| 6,133,723 | A | | 10/2000 | Feight |
| 6,147,416 | A | | 11/2000 | Mitsuzuka |
| 6,218,920 | B1 | | 4/2001 | Reichard et al. |
| 6,281,458 | B1 | | 8/2001 | Castonguay et al. |
| 6,403,909 | B1 | | 6/2002 | Green et al. |
| 6,559,743 | B2 | | 5/2003 | Narayanan et al. |
| 6,566,618 | B2 | | 5/2003 | Hamada et al. |
| 6,590,173 | B2 | | 7/2003 | Uchida et al. |
| 6,703,575 | B1 | | 3/2004 | Yamamoto |
| 6,768,412 | B2 | | 7/2004 | Becka et al. |
| 6,781,504 | B2 | | 8/2004 | Scott et al. |
| 6,791,440 | B2 | | 9/2004 | Harmon et al. |
| 6,794,595 | B2 | | 9/2004 | Charles et al. |
| 6,797,909 | B2 | | 9/2004 | Pride et al. |
| 6,825,426 | B2 | | 11/2004 | Muench et al. |
| 6,839,207 | B2 | | 1/2005 | Folliot et al. |
| 6,930,271 | B1 | | 8/2005 | Palmieri et al. |
| 7,002,440 | B2 | | 2/2006 | Attarian et al. |
| 7,019,606 | B2 | | 3/2006 | Williams et al. |
| 7,199,686 | B1 | | 4/2007 | Tsai |
| 7,330,097 | B2 | | 2/2008 | Takeda |
| 7,515,029 | B2 | | 4/2009 | Sahashi et al. |
| 7,623,010 | B2 | | 11/2009 | Liu |
| 7,683,287 | B2 | | 3/2010 | Lindsey et al. |
| 2003/0032892 | A1 | | 2/2003 | Erlach et al. |
| 2003/0034872 | A1 | | 2/2003 | Scott et al. |
| 2003/0187550 | A1 | | 10/2003 | Wilson et al. |
| 2004/0094394 | A1 | | 5/2004 | Muench et al. |
| 2004/0100741 | A1 | | 5/2004 | Bosga et al. |
| 2004/0150504 | A1 | | 8/2004 | Nicholsin |
| 2004/0169014 | A1 | | 9/2004 | Pride et al. |
| 2005/0003199 | A1 | | 1/2005 | Takaya et al. |
| 2005/0174211 | A1 | | 8/2005 | Takeda |
| 2005/0212629 | A1 | | 9/2005 | Williams et al. |
| 2006/0152308 | A1 | | 7/2006 | Rajauria et al. |
| 2007/0138143 | A1 | | 6/2007 | Muench et al. |
| 2007/0161270 | A1 | | 7/2007 | Insalaco et al. |
| 2007/0222467 | A1 | | 9/2007 | Nickson |
| 2009/0277768 | A1 | | 11/2009 | Brusky et al. |
| 2009/0278635 | A1 | | 11/2009 | Lindsey et al. |
| 2009/0278636 | A1 | | 11/2009 | Brusky et al. |
| 2009/0279216 | A1 | | 11/2009 | Brusky et al. |
| 2009/0279223 | A1 | | 11/2009 | Brusky et al. |
| 2010/0013583 | A1 | | 1/2010 | Kimura |
| 2010/0038220 | A1 | | 2/2010 | Lindsey et al. |
| 2010/0038221 | A1 | | 2/2010 | Lindsey et al. |
| 2010/0142102 | A1 | | 6/2010 | Brusky |

FOREIGN PATENT DOCUMENTS

| | | | |
|---|---|---|---|
| EP | 0034966 | A1 | 7/1984 |
| EP | 0727858 | A3 | 8/1996 |
| GB | 382656 | | 10/1932 |
| TW | 278039 | | 10/2005 |
| WO | WO9919891 | A1 | 4/1999 |
| WO | WO9960591 | A1 | 11/1999 |
| WO | WO0175919 | A1 | 10/2001 |

OTHER PUBLICATIONS

Cooper Power Systems, Fusing Equipment, MagneX™ Single-Phase Interrupter, Electrical Apparatus 240-34, Mar. 2006 (7 pages).
Shanghai Huaming Power Equipment Company brochure (4 pages).
Jaker Electric Co., Ltd., Taiwan, ROC; "Pole Mount Transformer Integrated Service" brochure, pp. 1-8; also see brochure at http://www.jaker.com.tw/np_pole01.htm; Sep. 23, 2006.
PCT International Search Report dated Jul. 30, 2010 (2 pages).

* cited by examiner

MULTI-DECK TRANSFORMER SWITCH

RELATED PATENT APPLICATIONS

This patent application is a continuation-in-part of co-pending U.S. patent application Ser. No. 12/191,750, entitled "Dual Voltage Switch," filed Aug. 14, 2008 now U.S. Pat. No. 7,872,203, which is related to U.S. patent application Ser. No. 12/191,761, entitled "Tap Changer Switch." The complete disclosure of each of the foregoing priority and related patent applications is hereby fully incorporated herein by reference.

TECHNICAL FIELD

The invention relates generally to transformer switches, and more particularly, to multi-deck tap changer switches for dielectric fluid-filled transformers.

BACKGROUND

A transformer is a device that transfers electrical energy from one circuit to another by magnetic coupling. Typically, a transformer includes one or more windings wrapped around a core. An alternating voltage applied to one winding (a "primary winding") creates a time-varying magnetic flux in the core, which induces a voltage in the other ("secondary") winding(s). Varying the relative number of turns of the primary and secondary windings about the core determines the ratio of the input and output voltages of the transformer. For example, a transformer with a turn ratio of 2:1 (primary: secondary) has an input voltage that is two times greater than its output voltage.

A transformer tap is a connection point along a transformer winding that allows the number of turns of the winding to be selected. Thus, a transformer tap enables a transformer to have variable turn ratios. Selection of the turn ratio in use is made by operating a tap changer switch. For simplicity, the term "switch" is used herein to refer to a tap changer switch. Popular turns ratios have evolved and have been standardized. One such standard is the dual voltage transformer that includes two windings which can be connected in series to handle a specified voltage and amperage, or in parallel to handle double the amperage at one half the series connected voltage.

Typical tap changer switch designs have also evolved to support the most popular standard turns ratios. For instance, a "dual voltage" switch is configured specifically for connection to the tap arrangement of a dual voltage transformer. Whereas a traditional switch has connection points for six taps of the transformer winding, a dual voltage switch has only four connection points.

Another typical switch in the art is a "multi-deck" switch that is created by stacking and connecting two or more tap changer switches together. The switches in the stack are all interconnected in such a way as to prevent independent operation. A multi-deck switch is employed for transformer winding configurations that have more taps than can be satisfied by one switch.

It is well known in the art to cool high-power transformers using a dielectric fluid, such as a highly-refined mineral oil. The dielectric fluid is stable at high temperatures and has excellent insulating properties for suppressing corona discharge and electric arcing in the transformer. Typically, the transformer includes a tank that is at least partially filled with the dielectric fluid. The dielectric fluid surrounds the transformer core and windings.

A core clamp extends from the core and maintains the relative positions of the core and the windings in the tank. A switch is mounted to a side wall of the tank. The switch includes one or more decks electrically coupled to at least one of the windings, for altering a voltage of the transformer.

Metallic screws and non-metallic bars are used to fasten the switch decks together in conventional multi-deck switches. The screws, while not electrically live, are conductive. Therefore, the screws can act to reduce electrical clearance between the switch contacts and the grounded tank wall and core clamp. To meet minimum electrical clearance to ground requirements, there must be at least a minimum distance between the live contacts, screws, and grounded tank wall and core clamp.

Minimum electrical clearances are required between the electrical contacts in the adjacent decks of a multi-deck switch. The bars that connect the decks together produce the distances between contacts that are necessary to comply with clearance requirements.

As the size of the switch increases, the tank must get wider or the switch must be mounted above the core clamp, in a taller tank, to meet the minimum distance requirement. As the size of the tank increases, the cost of acquiring and maintaining the transformer increases. For example, a larger transformer requires more space and more tank material. The larger transformer also requires more dielectric fluid to fill the transformer's larger tank. Thus, the cost of the transformer is directly proportional to the size of the switch.

Therefore, a need exists in the art for a switch having a decreased size. In addition, a need exists in the art for a switch with increased electrical clearance with the grounded tank wall. A further need exists in the art for a switch devoid of metallic screws for fastening the switch decks of a multideck switch, together.

SUMMARY

The invention provides a transformer switch, such as a multi-deck tap changer, having a decreased size and increased electrical clearance with a grounded tank wall and grounded core clamp. The switch includes one or more switch decks; each deck having a cover, a housing, and a rotor sandwiched between the cover and the housing. The rotor extends within a channel of the housing, from the top of the switch deck to an interior surface of the cover.

The cover includes a base member and a wall member extending from the base member. The wall member defines an interior space of the cover. For example, the wall member can extend substantially perpendicularly from the base member. Members extending from the wall member, within the interior space of the cover, define at least one pocket within the interior space. Each pocket is configured to receive a stationary contact associated with one or more windings of the transformer. For example, each member extending from the wall member can include a protrusion or notch configured to receive a notch or protrusion of a stationary contact.

In certain exemplary embodiments, each stationary contact is electrically coupled to one or more windings of a transformer. For example, a wire coupled to the transformer can be electrically coupled to the stationary contact via sonic welding, one or more quick connect terminals, or other suitable means known to a person of ordinary skill in the art having the benefit of this disclosure. In certain exemplary embodiments, the base member can include one or more holes configured to receive a wire associated with each stationary contact. The hole(s) also can be configured to allow ingress of dielectric fluids or egress of gases within the switch, to thereby provide greater isolation between switch contacts and electrically conductive grounded metal tank walls of the transformer.

The base member includes a protrusion extending from an interior surface of the cover. The protrusion is configured to receive a corresponding notch of the rotor. The rotor is configured to rotate about the protrusion to thereby move at least one movable contact relative to the stationary contacts in the pocket(s) of the cover.

Each movable contact is configured to be selectively electrically coupled to at least one of the stationary contacts. In certain exemplary embodiments each stationary contact-movable contact pairing corresponds to a different electrical configuration of the transformer windings, and thus, a different transformer voltage. For example, an operator can alter the transformer voltage using a handle coupled to the rotor.

The housing of the switch fits over the rotor, the movable contact(s), and the stationary contacts, attaching to the cover via one or more snap features of the housing or the cover. In certain exemplary embodiments, each of the cover and the housing is at least partially molded from a non-conductive material, such as a non-conductive plastic. In such embodiments, the electrical contacts of the transformer switch are captivated in proper locations by plastic molded switch body parts, without the need for metallic, mechanical fasters that traditionally have been employed in transformer switches. Elimination of metallic fasteners provides increased electrical clearance with the grounded tank wall. Similarly, elimination of sharp screw points and air trapped in screw holes increases dielectric and RIV performance.

In certain exemplary embodiments, the transformer switch includes multiple pairs of housings and covers. A first assembly includes a second housing formed integrally with a first cover. The first cover is coupled to a first housing via one or more snap features of the first housing or the first cover. The first cover holds at least a first stationary electric contact. The first housing and first cover together define a first interior volume within which the first stationary electric contact is disposed. The second housing of the first assembly is coupled to a second cover via one or more snap features of the second housing or the second cover, the second cover holding at least a second stationary electric contact. The second cover and the second housing together define a second interior volume within which the second stationary electric contact is disposed. Additional housing and cover pairs may be provided as desired. Each housing-cover pair includes an interior rotor rotatable relative to the stationary electric contact in the cover of the pair. The rotors contact one another such that rotation of one of the rotors causes rotation of the other rotor(s). At least one movable contact is coupled to each rotor. Rotation of the rotors causes rotation of the movable contacts relative to the stationary contacts.

These and other aspects, features and embodiments of the invention will become apparent to a person of ordinary skill in the art upon consideration of the following detailed description of illustrated embodiments exemplifying the best mode for carrying out the invention as presently perceived.

DETAILED DESCRIPTION OF EXEMPLARY EMBODIMENTS

The following description of exemplary embodiments refers to the attached drawings, in which like numerals indicate like elements throughout the several figures.

Figure 1:
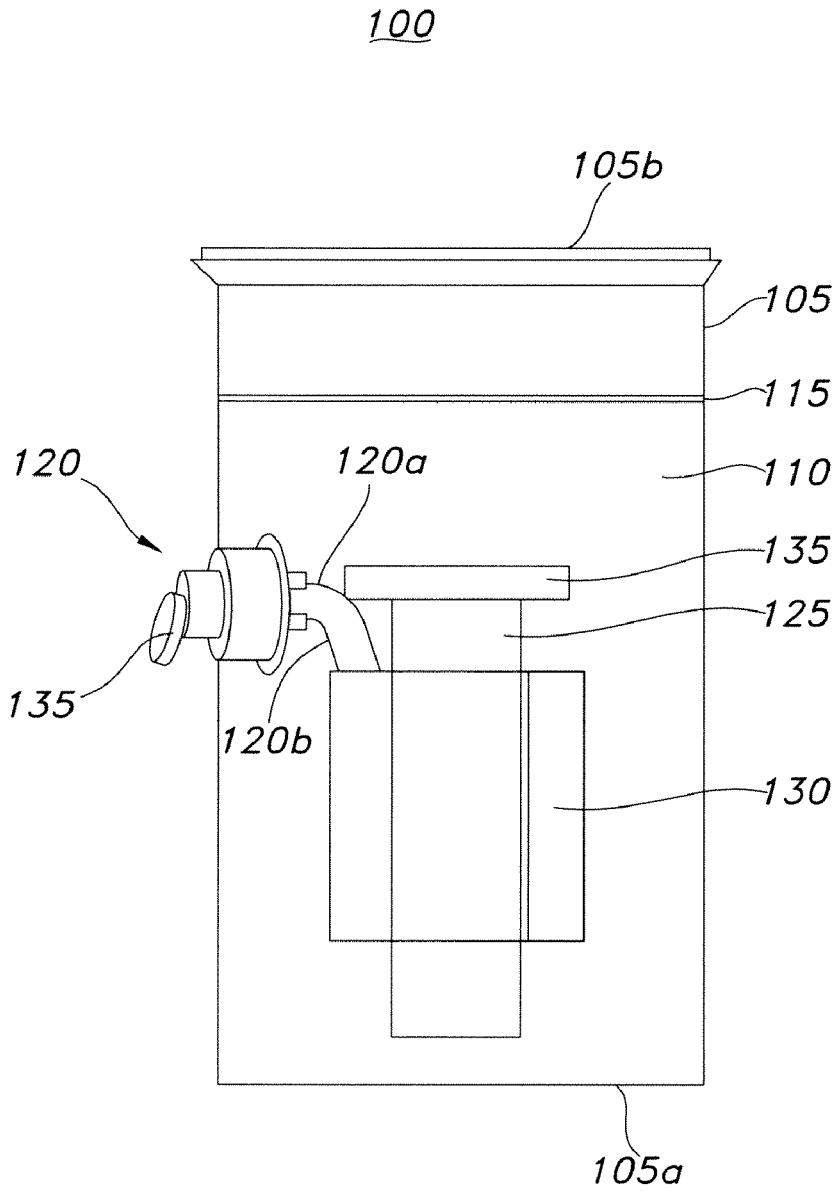
FIG. 1 is a perspective cross-sectional side view of a transformer, in accordance with certain exemplary embodiments.

FIG. 1 is a perspective cross-sectional side view of a transformer 100, in accordance with certain exemplary embodiments. The transformer 100 includes a tank 105 that is partially filled with a dielectric fluid 110. The dielectric 110 fluid includes any fluid that can withstand a steady electric field and act as an electrical insulator. For example, the dielectric fluid can include mineral oil. The dielectric fluid 110 extends from a bottom 105*a* of the tank to a height 115 proximate a top 105*b* of the tank 105. The dielectric fluid 110 surrounds a core 125 and windings 130 of the transformer 100. A core clamp 135 extends from the core 125 and maintains the relative positions of the core 125 and the windings 130 within the tank 105.

A switch 120 is mounted to a side wall of the tank 105 and is electrically coupled to a primary circuit of the transformer 100 via multiple wires 120*a*, 120*b*. The switch 120 is configured to alter a voltage of the transformer 100 by changing an electrical configuration of one or more windings 130 of the transformer 100 via the wires 120*a*, 120*b*. For example, the switch 120 can include a dual voltage switch or a tap changer switch. Certain exemplary embodiments of a dual voltage switch are described hereinafter with reference to FIGS. 3-15. Certain exemplary embodiments of a tap changer are described hereinafter with reference to FIGS. 16-28.

In certain exemplary embodiments, if the switch 120 is a dual voltage switch, the wires 120*a*, 120*b* can extend between the switch 120 and one or more of the windings 130 of the transformer 105, and additional wires (not shown) can extend between the switch 120 and one or more fused bushings (not shown) disposed proximate the top 105*b* of the tank 105. Each fused bushing is a high-voltage insulated member, which is electrically coupled to an external power source (not shown) of the transformer 100. If the switch 120 is a tap changer switch, the wires 120*a*, 120*b* can extend between the switch 120 and windings 130 of the transformer 105 without any additional wires extending between the switch 120 and any bushings of the transformer 100. Circuit connections of exemplary dual voltage and tap changer switches are described hereinafter with reference to FIGS. 31-33.

The switch 120 includes stationary contacts (not shown), each of which is electrically coupled to one or more of the wires 120*a*, 120*b*. For example, the stationary contacts and wires 120*a*, 120*b* can be sonic welded together or connected via male and female quick connect terminals (not shown) or other suitable means known to a person of ordinary skill in the art having the benefit of this disclosure. At least one movable contact (not shown) of the switch 120 can be selectively electrically coupled to one or more of the stationary contacts. For example, each movable contact-stationary contact pairing can correspond to a different electrical configuration of the windings 130, and thus, a different voltage of the transformer 100. In certain exemplary embodiments, an operator can rotate a handle 135 associated with the switch 120 to select the stationary contact(s), if any, to which the movable contact(s) will be electrically coupled.

Figure 2:
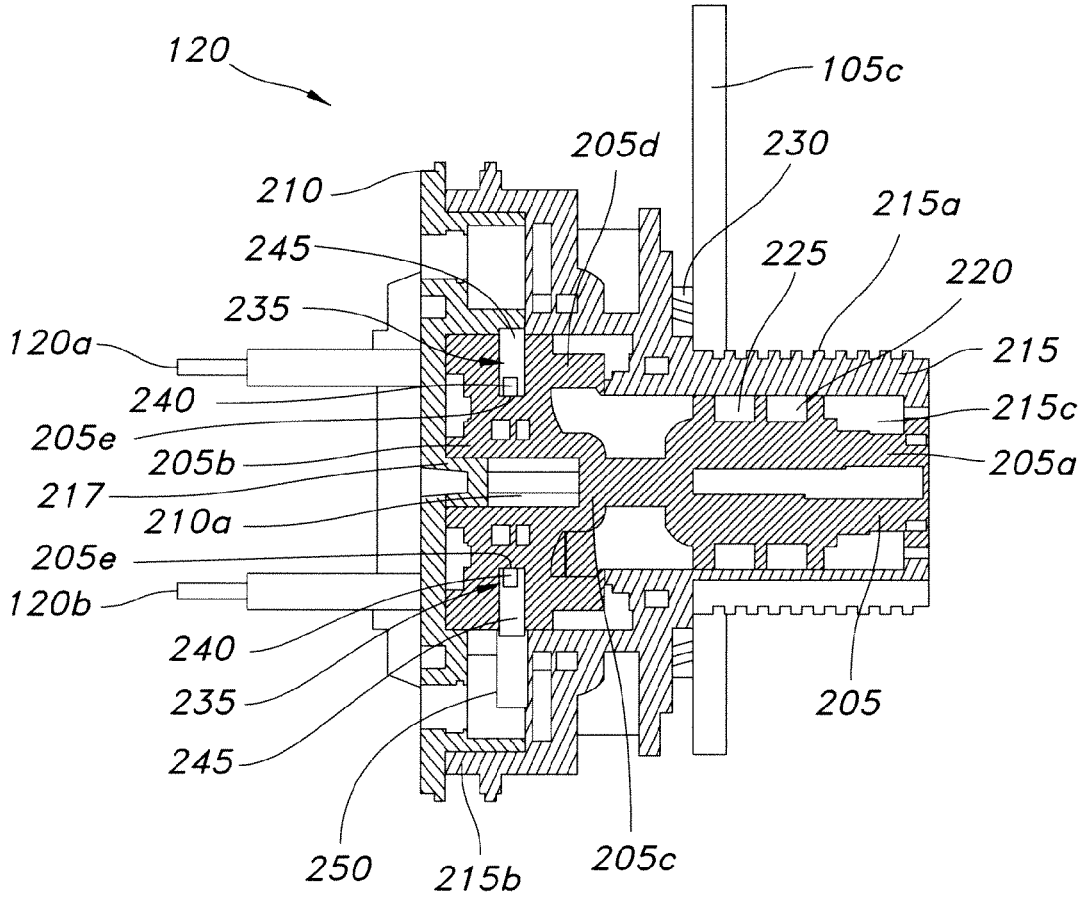
FIG. 2 is a cross-sectional side view of a switch mounted to a tank wall of a transformer, in accordance with certain exemplary embodiments.

FIG. 2 is a cross-sectional side view of a switch 120 mounted to a tank wall 105*c* of a transformer (not shown), in accordance with certain exemplary embodiments. The switch 120 includes an elongated rotor 205 disposed between a cover 210 and a housing 215 of the switch 120. The housing 215 extends through the tank wall 105*c*, with a first end 215*a* of the housing 215 being disposed outside the tank (not shown) and a second end 215*b* of the housing 215 being disposed inside the tank. The first end 215*a* includes one or more grooves 215*d*.

In certain exemplary embodiments, an assembly nut (not shown) can be twisted about the grooves 215*d* to hold the switch 120 onto the tank wall 105*c* and to compress the gasket 230. Compressing the gasket 230 creates a mechanical seal between the tank wall 105*c* and the housing 215. The second end 215*b* of the housing 215 is removably attached to the cover 210 via one or more snap features 217 of the cover 210. Each of the snap features 217 includes one or more pieces of plastic configured to grip at least a portion of the cover 210. In certain alternative exemplary embodiments, the housing 215 can include the snap feature(s) 217. Each of the housing 215 and the cover 210 is at least partially molded from a non-conductive material, such as a non-conductive plastic.

The elongated rotor 205 extends within an interior channel 215*c* of the housing 215, with a first end 205*a* of the rotor 205 being disposed outside the tank and a second end 205*b* of the rotor 205 being disposed inside the tank. Two o-rings 220, 225 are disposed about a portion of the rotor 205, proximate the first end 205*a* of the rotor 205. The o-rings 220, 225 maintain a mechanical seal between the rotor first end 205*a* and the housing 215.

A person of ordinary skill in the art having the benefit of this disclosure will recognize that many other means exist for maintaining mechanical seals between the housing 215, the rotor 205, and the tank wall 105*c*. For example, in certain alternative exemplary embodiments, the housing 215 can snap into the tank wall 105*c*, the gasket 230 can be molded onto the housing 215 using a "two-shot" molding process, and/or the gasket 230 can be adhered to the housing 215 using adhesive.

The second end 205*b* of the rotor 205 includes a notch 205*c* configured to receive a corresponding protrusion 210*a* of the cover 210. Thus, the rotor 205 is essentially sandwiched between the cover 210 and the housing 215. The rotor 210 is configured to rotate, within the housing 215, about the protrusion 210*a* of the cover 210. For example, a force applied to a handle (not shown) coupled to the rotor 205 can cause the rotor 205 to rotate about the protrusion 210*a*. In certain exemplary embodiments, the notch 205*c* extends deeper than the height of the protrusion 210*a*, leaving a gap between the protrusion 210*a* and the notch 205*c*. The gap is configured to be filled with dielectric fluid 110 (FIG. 1) of the transformer 100 to prevent dielectric breakdown between movable contacts 245 of the switch 120.

At least one movable contact assembly 235 is coupled to a side 205*d* of the rotor 205. Each movable contact assembly 235 includes a spring 240 and a movable contact 245. The movable contact 245 includes an electrically conductive material, such as copper. In certain exemplary embodiments, the movable contact 245 is silver plated to provide extra protection against coaking. Coaking is a condition in which dielectric fluid in a transformer can change states due to localized heating at the contact face. It has been proven that silver plating on a contact can greatly reduce this localized heating and the coaking resulting therefrom.

The movable contact assembly 235 extends perpendicularly from the side 205*d* of the rotor 205, with the spring 240 being disposed between the movable contact 245 and the rotor 205. The spring 240 and at least a portion of the movable contact 245 are disposed within a recess 205*e* in the side 205*d* of the rotor 205. Rotation of the rotor 205 about the protrusion 210*a* causes similar rotational movement of each movable contact assembly 235.

That rotation causes the movable contact 245 of each movable contact assembly 235 to move relative to one or more stationary contacts 250 disposed within the cover 210. Each of the stationary contacts 250 includes an electrically conductive material, such as copper, which is electrically coupled to at least one transformer winding (not shown) via one or more wires 120*a*, 120*b*. The stationary contacts 250 and wires 120*a*, 120*b* are electrically coupled to one another via sonic welding, male and female quick connect terminals, or other suitable means known to a person of ordinary skill in the art having the benefit of this disclosure. In certain exemplary embodiments, one or more of the stationary contacts 250 can be silver plated instead of, or in addition to, plating the movable contacts 245. Silver plating both the stationary contacts 250 and the movable contacts 245 provides greater resistance to coaking. For example, if quick connect connections are used to connect the stationary contacts 250 and wires 120*a*, 120*b*, silver plating may be disposed proximate the joint of the stationary contacts 250 and wires 120*a*, 120*b* to reduce heating.

Movement of the movable contact(s) 245 relative to the stationary contacts 250 alters a voltage of the transformer by changing an electrical configuration of the windings via the wires 120*a*, 120*b*. For example, each movable contact 245-stationary contact 250 pairing can correspond to a different electrical configuration of the windings, and thus, a different voltage of the transformer. Certain exemplary electrical configurations are described in more detail below, with reference to FIGS. 12-13 and 25-26.

Figure 3:
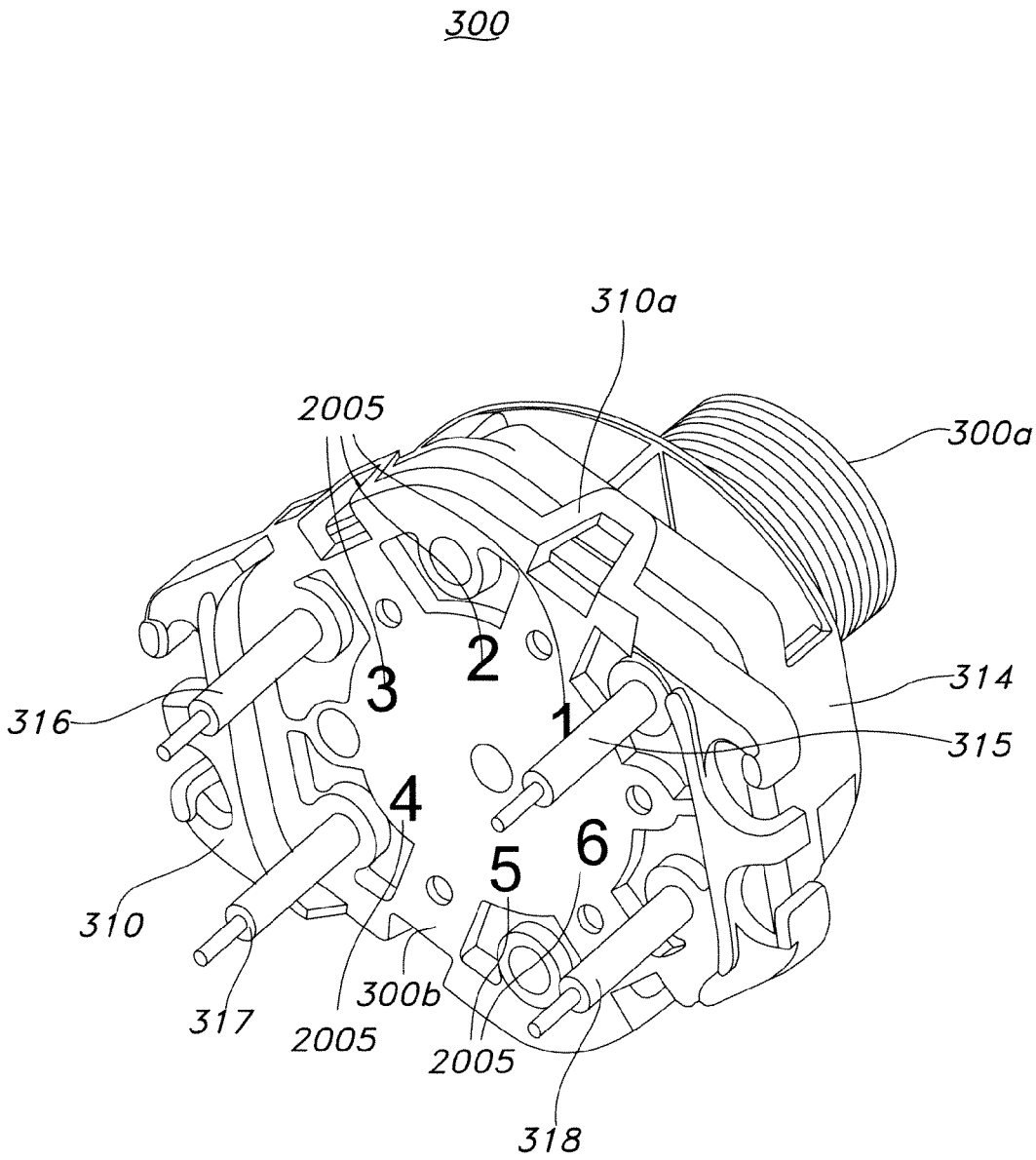
FIG. 3 is an isometric bottom view of a dual voltage switch, in accordance with certain exemplary embodiments.
Figure 4:
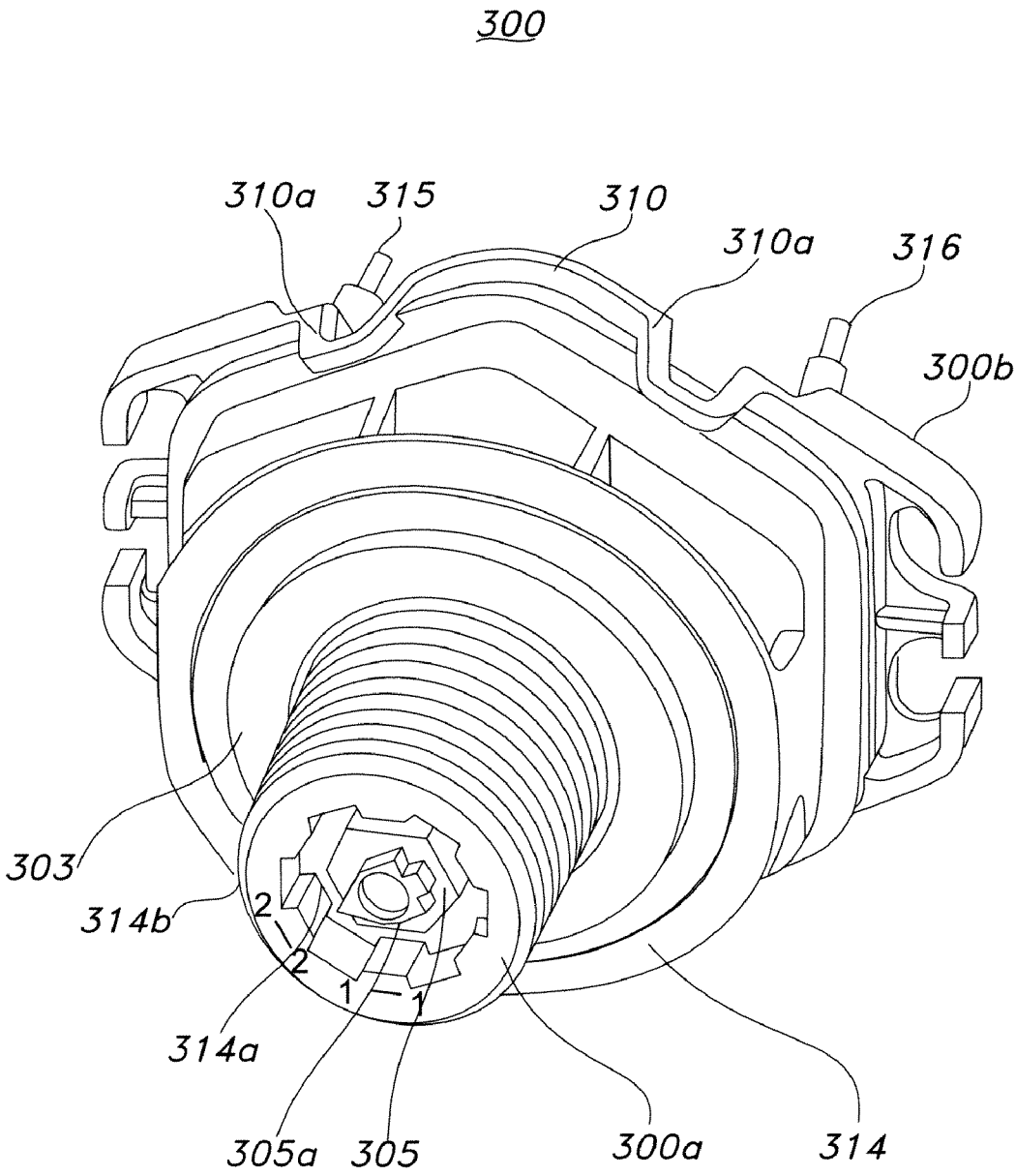
FIG. 4 is an isometric top view of a dual voltage switch, in accordance with certain exemplary embodiments.

FIG. 3 is an isometric bottom view of a dual voltage switch 300, in accordance with certain exemplary embodiments. FIG. 4 is an isometric top view of the dual voltage switch 300 and a flat cylindrical gasket 303, in accordance with certain exemplary embodiments. The dual voltage switch 300 is configured to alter the voltage of a transformer (not shown) electrically coupled thereto by changing an electrical configuration of the transformer's windings (not shown) from an in-series configuration to an in-parallel configuration or vice versa.

As with the switch 120 depicted in FIG. 2, the dual voltage switch 300 includes an elongated rotor 305 disposed between a cover 310 and a housing 314 of the dual voltage switch 300. The cover 310 is removably coupled to the housing 314 via one or more snap features 310*a* of the cover 310. In certain alternative exemplary embodiments, the housing 314 can include the snap feature(s) 310*a*. Each of the housing 314 and the cover 310 is at least partially molded from a non-conductive material, such as a non-conductive plastic.

The snap-together relationship between the cover 310 and the housing 314 can eliminate the need for hardware used to connect the cover 310 and the housing 314. For example, the snap-together relationship can allow only a few or even no metallic screws to join the cover 310 and the housing 314. Thus, the switch 300 can have a reduced size compared to traditional switches that require such screws. The reduced size of the switch 300 can allow a transformer tank associated with the switch 300 to have a reduced size, while still meeting minimum electrical clearance to ground requirements.

The rotor 305 is disposed within an interior channel 314*a* of the housing 314 and is essentially sandwiched between an interior surface of the cover 310 and the interior channel 314*a* of the housing 314. Two o-rings (not shown) are disposed about a portion of the rotor 305, within the interior channel 314*a*. The o-rings and the flat cylindrical gasket 303 disposed about the housing 314 are configured to maintain mechanical seals between the housing 314, the rotor 305, and a tank wall (not shown) of the transformer.

In operation, a first end 300*a* of the dual voltage switch 300, including an upper portion 314*b* of the housing 314 and an upper portion 305*a* of the rotor 305, is disposed outside the transformer tank (not shown), and a second end 300*b* of the dual voltage switch 300, including the remaining portions of the housing 314 and the rotor 305, the gasket 303, the cover 310, certain stationary contacts (not shown) and movable contact assemblies (not shown) coupled to the cover 310 and the rotor 305, respectively, and certain wires 315-318 electrically coupled to the stationary contacts, is disposed inside the transformer tank.

The stationary contacts and wires 315-318 are electrically coupled to one another via sonic welding, male and female quick connect terminals, or other suitable means known to a person of ordinary skill in the art having the benefit of this disclosure. The wires 315-318 extend from the stationary contacts and are each electrically coupled to a primary circuit of the transformer. For example, wires 315 and 316 can be electrically coupled to one or more primary bushings of the transformer, and wires 317 and 318 can be coupled to one or more windings of the transformer.

As described in more detail below, with reference to FIGS. 12-13, movement of the movable contacts relative to the stationary contacts alters a voltage of the transformer by changing an electrical configuration of the windings from an in-series configuration to an in-parallel configuration or vice versa. For example, a first arrangement of the stationary and movable contacts can correspond to the in-series configuration, and a second arrangement of the stationary and movable contacts can correspond to the in-parallel configuration. In certain exemplary embodiments, an operator can rotate a handle (not shown) coupled to the rotor 305 to move the movable contacts relative to the stationary contacts.

Figure 5:
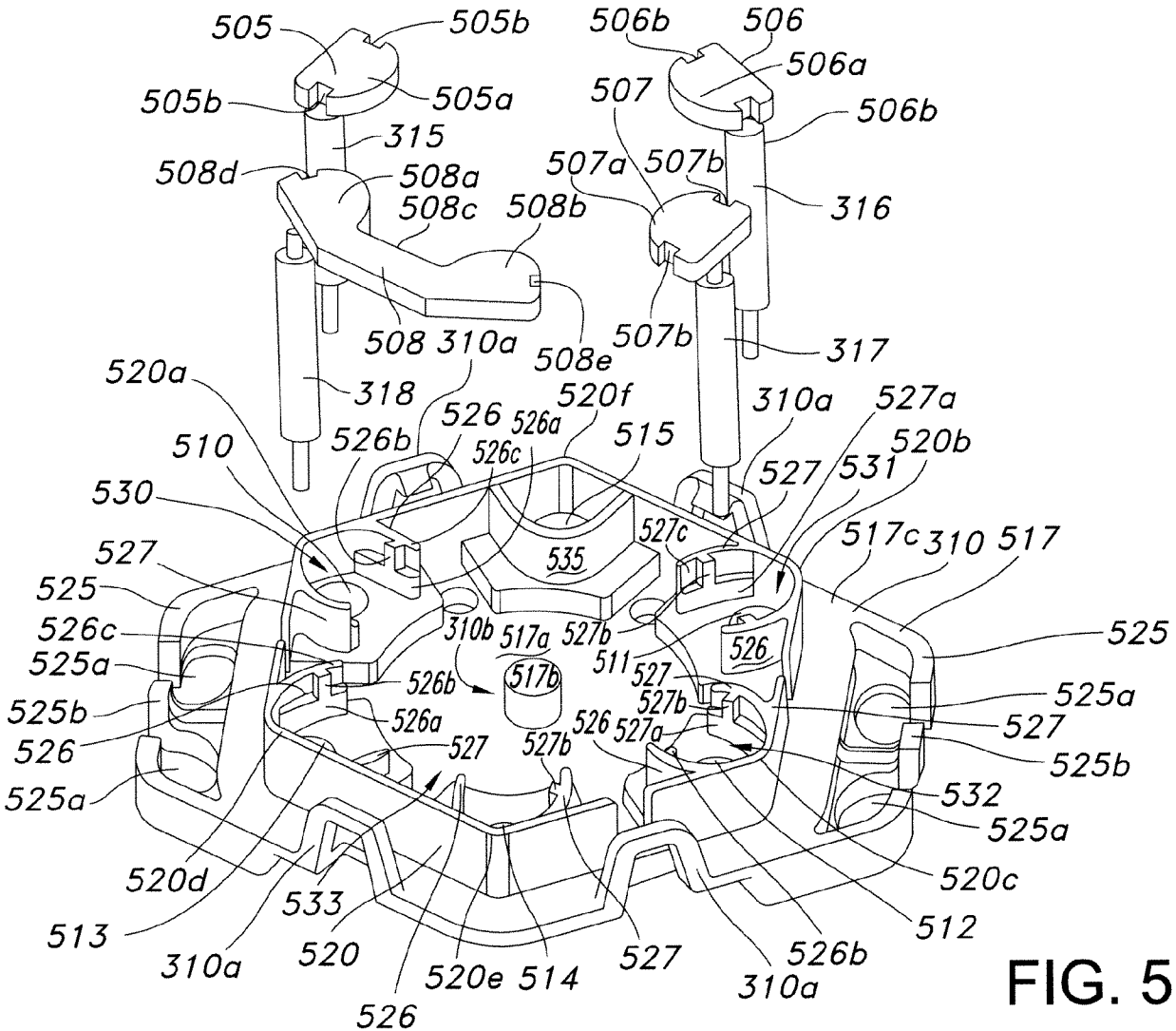
FIG. 5 is an exploded perspective side view of a cover, stationary contacts, and wires of a dual voltage switch, in accordance with certain exemplary embodiments.

A method of manufacturing the dual voltage switch 300 will now be described with reference to FIGS. 5-11. FIG. 5 is an exploded perspective side view of the cover 310, the stationary contacts 505-508, and the wires 315-318 of the dual voltage switch 300, in accordance with certain exemplary embodiments. In a first step, the stationary contacts 505-508 and the wires 315-318 electrically coupled thereto are aligned with stationary contact holes 510-513 in the cover 310.

The cover 310 includes a base member 517, a hexagon-shaped wall member 520, and a pair of wire guide members 525. The base member 517 is substantially hexagonal-shaped, with a substantially circular inner region 517*a*. The base member 517 includes the snap features 310*a* of the cover 310. The snap features 310*a* are configured to engage a side surface of a housing (not shown) of the dual voltage switch, as described hereinafter with reference to FIGS. 10-11. The base member 517 also includes a protrusion 517*b* configured to receive a notch of a rotor (not shown) of the dual voltage switch, as described hereinafter with reference to FIG. 7.

The wire guide members 525 include apertures 525*a* and a notch 525*b* for wrapping one or more of the wires 315-318 about the cover 310. Thus, the wire guide members 525 are configured to retain the wires 315-318 within the transformer tank. The integral wire guide members 525 of the switch 300 can eliminate the need for separate wire guides attached to a core clamp of the transformer, as in traditional switches. In certain alternative exemplary embodiments, the cover 310 may not include wire guide members 525.

The hexagon-shaped wall member 520 extends substantially perpendicularly from a surface 517*c* of the base member 517 and thereby defines an interior space 310*b* of the cover 310. The stationary contact holes 510-513 are disposed within the base member 517, proximate corners 520*a*-520*d*, respectively, of the hexagon-shaped wall member 520. Other, similar holes 514-515 are disposed within the base member 517, proximate the remaining corners 520*e*-520*f*, respectively, of the hexagon-shaped wall member 520.

Elongated members 526-527 are disposed on opposite sides of each of the contact holes 510-512 and proximate first and second sides of contact holes 513 and 514, respectively. Each elongated member 526, 527 includes a support member 526*a*, 527*a*, a protrusion 526*b*, 527*b*, and an upper member 526*c*, 527*c*. The elongated members 526-527, the base member 517, and the hexagon-shaped wall member 520 define pockets 530-533 in the cover 310, wherein each pocket 530-533 is configured to receive a stationary contact 505-508.

Each of the stationary contacts 505-508 includes an electrically conductive material, such as copper. Each of the stationary contacts 505-507 is a "single button" contact with a single, substantially semi-circular member 505*a*, 506*a*, 507*a* having a pair of notches 505*b*, 506*b*, 507*b* disposed on opposite sides thereof. In certain alternative exemplary embodiments described in more detail hereinafter with reference to FIG. 29, one or more of the stationary contacts 505-507 can include a "pointed" member in place of the semi-circular member 505*a*, 506*a*, 507*a*, to increase electrical clearance between neighboring contacts 505-508. Each notch 505*b*, 506*b*, 507*b* is configured to slidably engage a corresponding protrusion 526*b*, 527*b* of the elongated member 526, 527 disposed proximate thereto.

Stationary contact 508 is a "double button" contact with two, substantially semi-circular members 508*a*-508*b* disposed on opposite sides of an elongated member 508*c*. The elongated member 508*c* allows for an integral connection between the members 508*a*-508*b*. In certain alternative exemplary embodiments, the double button contact 508 may be replaced with contacts connected via one or more discrete, internal connectors. In certain additional alternative exemplary embodiments described in more detail hereinafter with reference to FIG. 30, one or more of the semi-circular members 508*a*-508*b* can be replaced with a pointed member, to increase electrical clearance between neighboring contacts 505-508.

Each of the members 508*a*, 508*b* is offset from the elongated member 508*c* such that a non-zero, acute angle exists between a bottom edge of each member 508*a*, 508*b* and a bottom edge of the elongated member 508*c*. This geometry, coupled with the relative spacing of the other contacts 505-507 within the cover 310, allows smooth rotation and selective coupling of the movable contacts of the switch and the stationary contacts 505-508 during an operation of the switch. For example, this geometry allows the movable contacts to be in line with one another, having an incident angle between their axes of force to be 180 degrees. The movable contacts are described in more detail below.

Member 508*a* includes a notch 508*d* configured to slidably engage a corresponding protrusion 526*b* of the elongated member 526 disposed proximate thereto. Member 508*b* includes a notch 508*e* configured to slidably engage a corresponding protrusion 527*b* of the elongated member 527 disposed proximate thereto.

The stationary contacts 505-508 are electrically coupled to the wires 315-318, respectively, via sonic welding, male and female quick connect terminals, or other suitable means known to a person of ordinary skill in the art having the benefit of this disclosure. For example, the wires 315-318 can be sonic welded to bottom surfaces of semi-circular members 505*a*, 506*a*, 507*a*, 508*a*, respectively.

Figure 6:
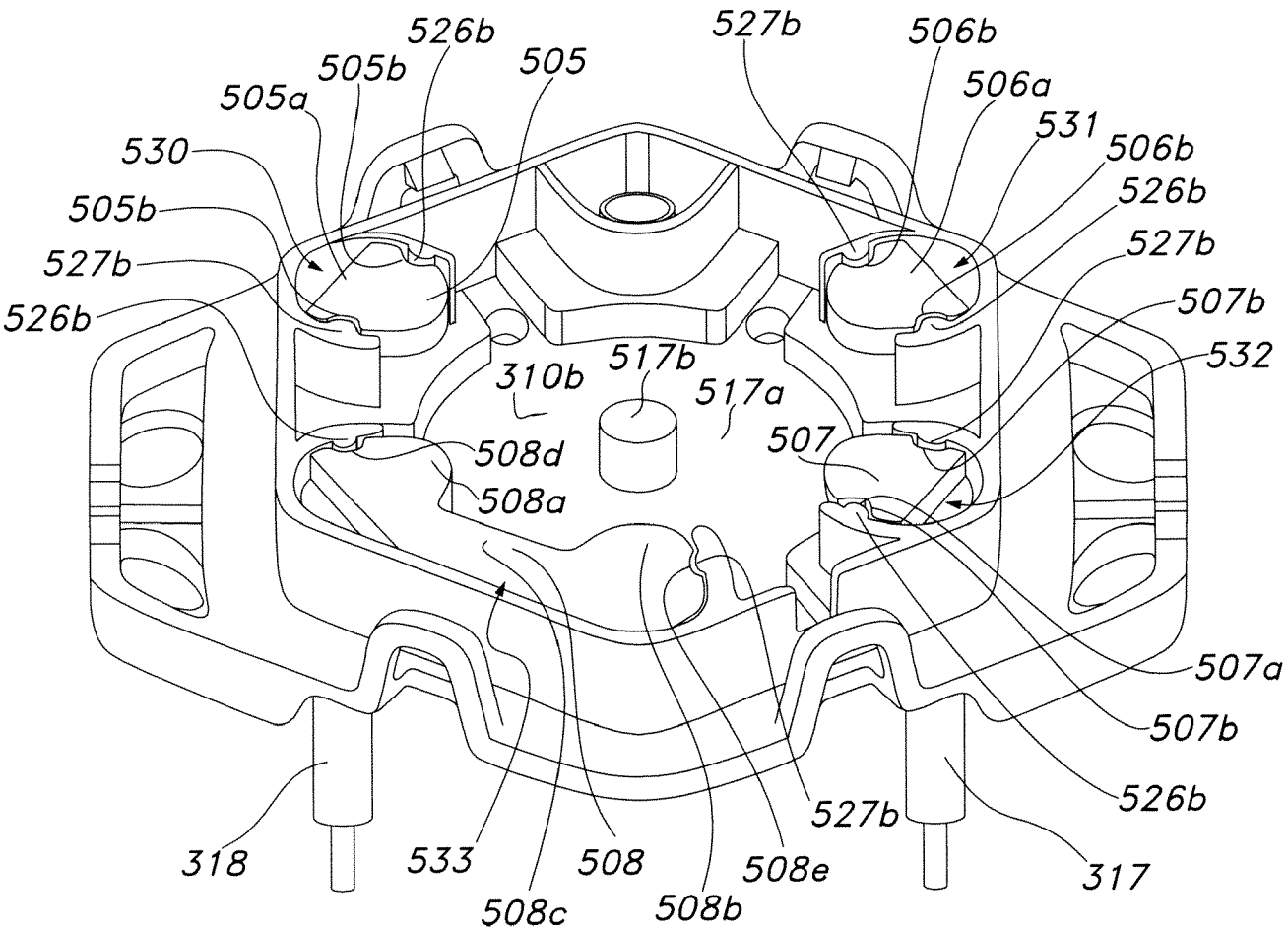
FIG. 6 is a perspective side view of stationary contacts and wires assembled within a cover of a dual voltage switch, in accordance with certain exemplary embodiments.

In a second step of manufacturing the dual voltage switch 300, the stationary contacts 505-508 are inserted into the pockets 530-533 of the cover 310, as illustrated in FIG. 6. With reference to FIGS. 5 and 6, a bottom surface of each stationary contact 505-508 rests on the support members 526*a*, 527*a* of the elongated members 526-527 disposed proximate thereto; side surfaces of each stationary contact 505-508 engage the upper members 526*c*-527*c* of the elongated members 526-527 disposed proximate thereto; and the notches 505*b*, 506*b*, 507*b*, 508*d*, and 508*e* of each stationary contact 505-508 engage the protrusions 526*b*-527*b* of the elongated members disposed proximate thereto. Thus, the stationary contacts 505-508 are suspended from the base member 517, with gaps being disposed below the stationary contacts 505-508 and between the contacts 505-508 and the wall member 520. The gaps are configured to be filled with dielectric fluid 110 to cool the contacts 505-508 and the wires 315-318 and to prevent dielectric breakdown. The gaps also provide clearance for the contacts 505-508 and wires 315-318.

The wires 315-318 electrically coupled to the stationary contacts 505-508 extend through the stationary contact holes 510-513 in the cover 310. Each wire 315-318 may be electrically coupled to a primary circuit of a transformer to be controlled by the dual voltage switch containing the cover 310, stationary contacts 505-508, and wires 315-318. For example, wires 315 and 316 can be coupled to one or more primary bushings of the transformer, and wires 317 and 318 can be coupled to one or more windings of the transformer.

Each pocket 530-533, hole, and space within the cover 310, including the interior space 310*b*, is configured to allow ingress and egress of dielectric fluid within the transformer. For example, although holes 514-515 are not configured to receive a wire 315-318, they are included, in certain exemplary embodiments, to allow ingress and/or egress of dielectric fluid. The dielectric fluid can provide greater isolation between the stationary contacts 505-508, the movable contacts (not shown), and the metal walls of the transformer tank.

Figure 7:
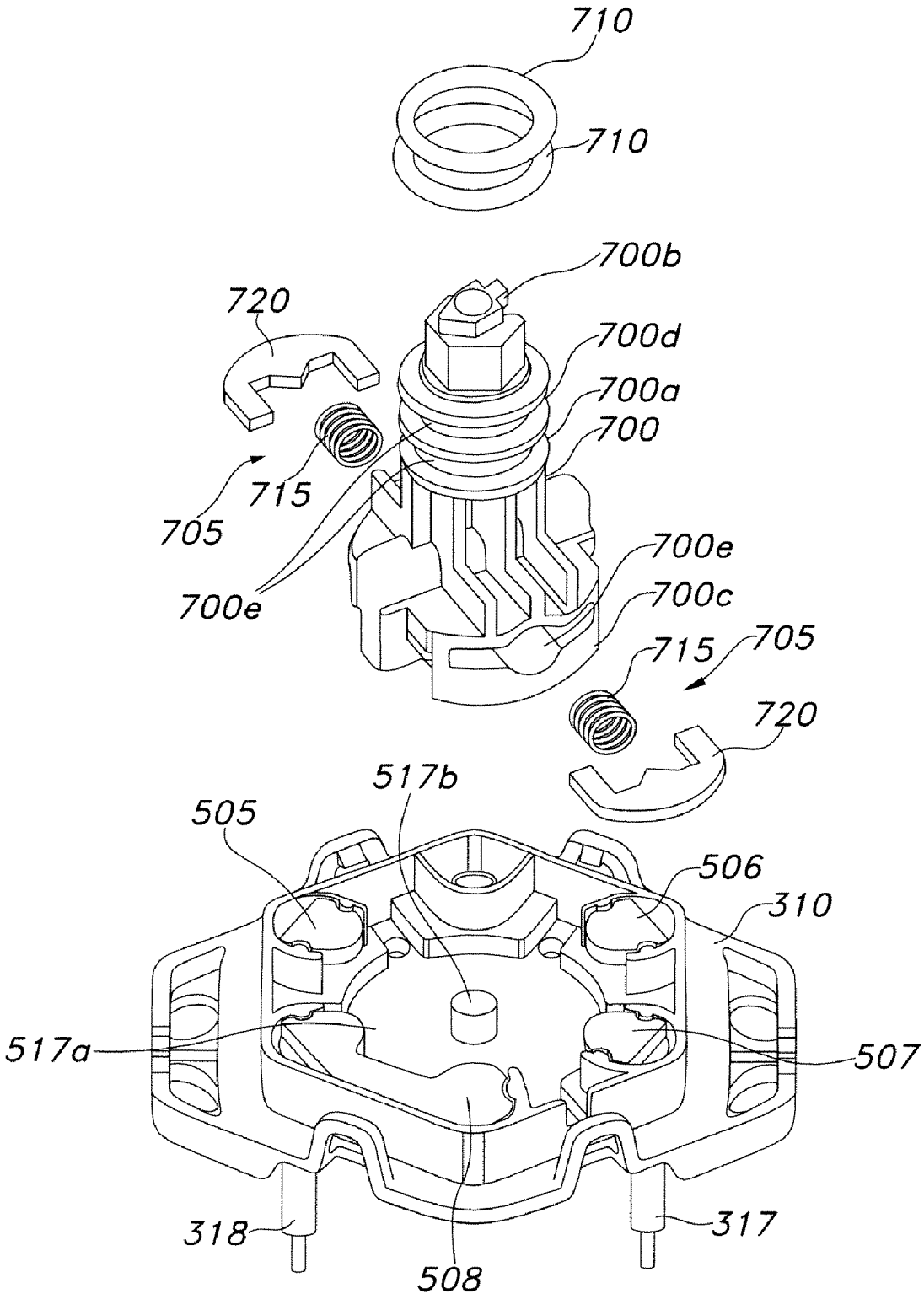
FIG. 7 is a partially exploded perspective side view of a cover, stationary contacts, wires, movable contact assemblies, a rotor, and o-rings of a dual voltage switch, in accordance with certain exemplary embodiments.

In a third step of manufacturing the dual voltage switch 300, a rotor 700, movable contact assemblies 705, and a pair of o-rings 710 are coupled to the cover 310. FIG. 7 is a partially exploded perspective side view of the cover 310, the stationary contacts 505-508, the wires 315-318, the rotor 700, the movable contact assemblies 705, and the o-rings 710, in accordance with certain exemplary embodiments.

The rotor 700 includes an elongated member 700*a* having a top end 700*b*, a bottom end 700*c*, and a middle portion 700*d*. The top end 700*b* has a substantially hexagonal-shaped cross-sectional geometry. The middle portion 700*d* of the rotor 700 has a substantially circular cross-sectional geometry with round grooves 700*e* configured to receive the o-rings 710. The o-rings 710 are configured to work in conjunction with a gasket (not shown) to maintain a mechanical seal of the dual voltage switch and a tank wall (not shown) of the transformer. For example, the o-rings 710 may include nitrile rubber or fluorocarbon members.

The bottom end 700*c* of the rotor 700 has a substantially circular cross-sectional geometry, which corresponds to the shape of the inner region 517*a* of the base member 517. The bottom end 700*c* includes a notch (not shown) configured to receive the protrusion 517*b* of the base member 517. The rotor 700 is configured to rotate about the protrusion 517*b*. For example, similar to a ratchet socket on a hex nut, an operating handle (not shown) may engage the top end 700*b* of the rotor 700 to rotate the rotor 700 about the protrusion 517*b*.

The movable contact assemblies 705 are coupled to opposite sides of the rotor 700, proximate the bottom end 700*c*. Each movable contact assembly 705 includes a spring 715 and a movable contact 720. Each movable contact 720 includes an electrically conductive material, such as copper. In certain exemplary embodiments, the movable contact 720 is silver plated to provide extra protection against coaking.

Each movable contact assembly 705 extends perpendicularly from a side of the rotor 700, with the spring 715 of each assembly 705 being disposed between the rotor 700 and the movable contact 720 of the assembly 705. For each movable contact assembly 705, the spring 715 and at least a portion of the movable contact 720 are disposed within a recess 700*e* in the side of the rotor 700. To install the rotor 700 and movable contact assembly 705 in the switch, the movable contacts 720 are pushed back into the recess 700*e*, thereby compressing the springs 715. While the movable contacts 720 are depressed and the springs 715 are still compressed, the rotor 700 is set in place on the protrusion 517*b*. The movable contacts 720 are then released and come in contact with one or more of the stationary contacts 505-508.

The springs 715 remain partially compressed, causing contact pressure between the stationary and movable contacts. The contact pressure can cause the rotor 700 to be retained within the cover 310 until a corresponding housing (900 in FIG. 9) can be snapped into place. The contact pressure also can help to electrically couple the contacts by allowing current to flow between the contacts. High contact pressure can reduce electrical heating of the contacts, but also can make it more difficult to rotate the rotor 700. High contact pressure and the greater torque required to operate the rotor 700 can cause breakage of the rotor 700 or cover 310 if those forces exceed the mechanical strength of the components of the switch. An appropriate amount of contact pressure can be achieved by balancing these concerns and selecting component materials and mechanical relationships between the component materials that comply with specifications for maximum contact operating temperatures and switch operating torque.

Rotation of the rotor 700 about the protrusion 517*b* causes similar axial movement of each movable contact assembly 705. That rotation causes the movable contact 720 of each movable contact assembly 705 to move relative to one or more of the stationary contacts 505-508 disposed within the cover 310. As described in more detail hereinafter, with reference to FIGS. 12-13, movement of the movable contacts 720 relative to the stationary contacts 505-508 alters a voltage of the transformer by changing an electrical configuration of the windings from an in-series configuration to an in-parallel configuration or vice versa. In certain exemplary embodiments, an operator can rotate a handle (not shown) coupled to the rotor 700 to move the movable contacts 720 relative to the stationary contacts 505-508.

As the rotor 700 is rotated, a bridge between the movable contacts 720 and the adjacent stationary contacts 505-508 is broken. As the movable contacts 720 slide by the stationary contacts 505-508 in the direction of rotation, the contacts 720 are further depressed into the recess 700*e*. The greatest depression occurs when the contacts 720, 505-508 are in direct alignment. The dimensions of the recess 700*e*, springs 715, contacts 720, 505-508, cover 310, etc. can be such that the springs 715 are not compressed solid when the contacts 720, 505-508 are aligned. As the rotor 700 is rotated further past direct contact alignment, the movable contacts 720 "snap" back out and into place, once again bridging the next pair of stationary contacts 505-508. The snap back motion can provide a desirable tactile feel to the contacts 720 "snapping out," which can inform an operator that the switch 300 has been switched to another operating position.

Figure 8:
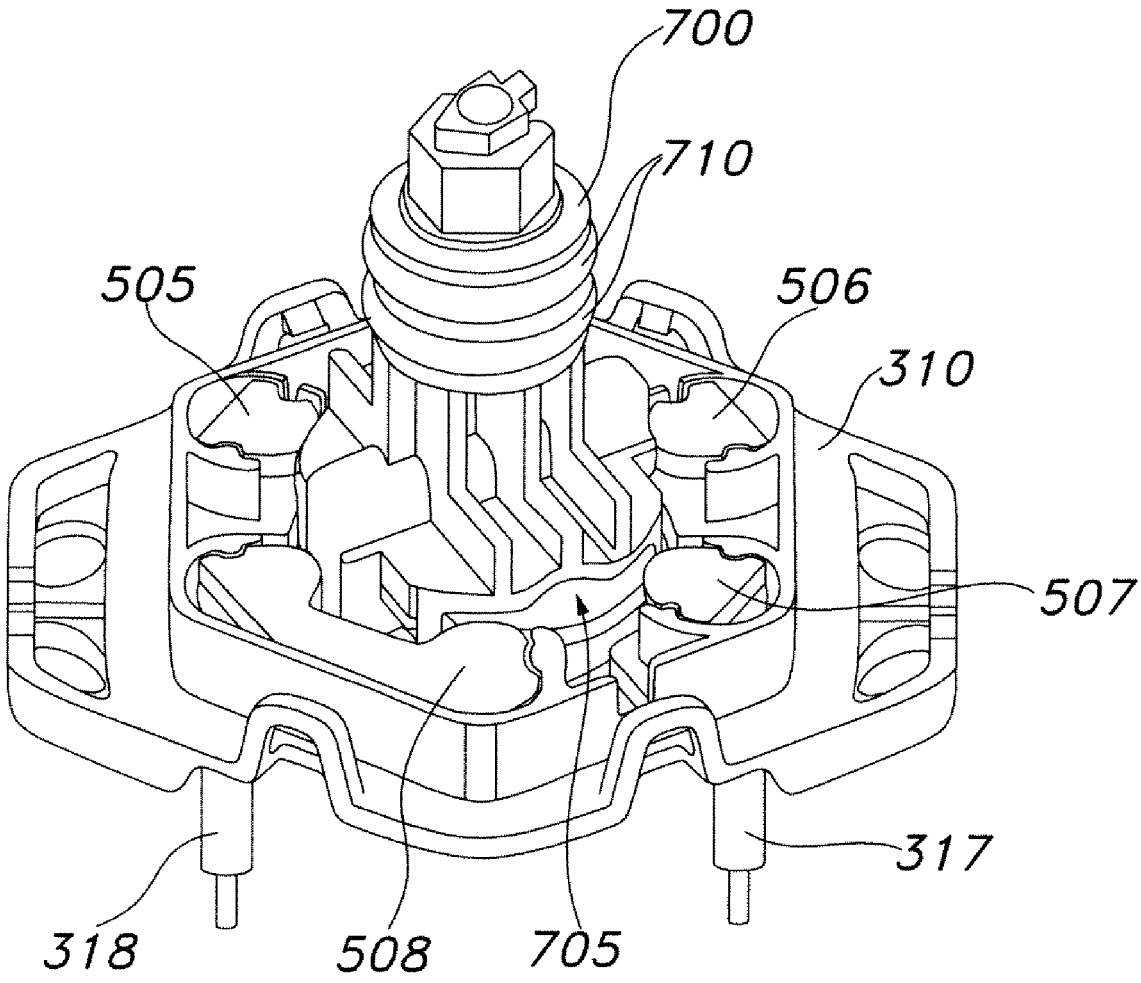
FIG. 8 is a perspective side view of stationary contacts, wires, a rotor, o-rings, and movable contact assemblies assembled within a cover of a dual voltage switch, in accordance with certain exemplary embodiments.

FIG. 8 is a perspective side view of the stationary contacts 505-508, the wires 315-318, the rotor 700, the o-rings 710, and the movable contact assemblies 705 assembled within the cover 310 of the dual voltage switch, in accordance with certain exemplary embodiments. With reference to FIGS. 7-8, the o-rings 710 are disposed about the round grooves 700*e* in the middle portion 700*d* of the rotor 700. The bottom end 700*c* of the rotor 700 is resting on the inner region 517*a* of the base member 517, with the notch of the rotor 700 being rotatably disposed about the protrusion 517*b* of the base member 517.

For each movable contact assembly 705, the spring 715 and at least a portion of the movable contact 720 are disposed within the recess 700*e* in the side of the rotor 700. An outer edge of each movable contact 720 is biased against, and thereby electrically coupled to, at least one of the stationary contacts 505-508. For example, movable contact 720*a* (FIG. 12) is electrically coupled to stationary contacts 507 and 508.

Figure 9:
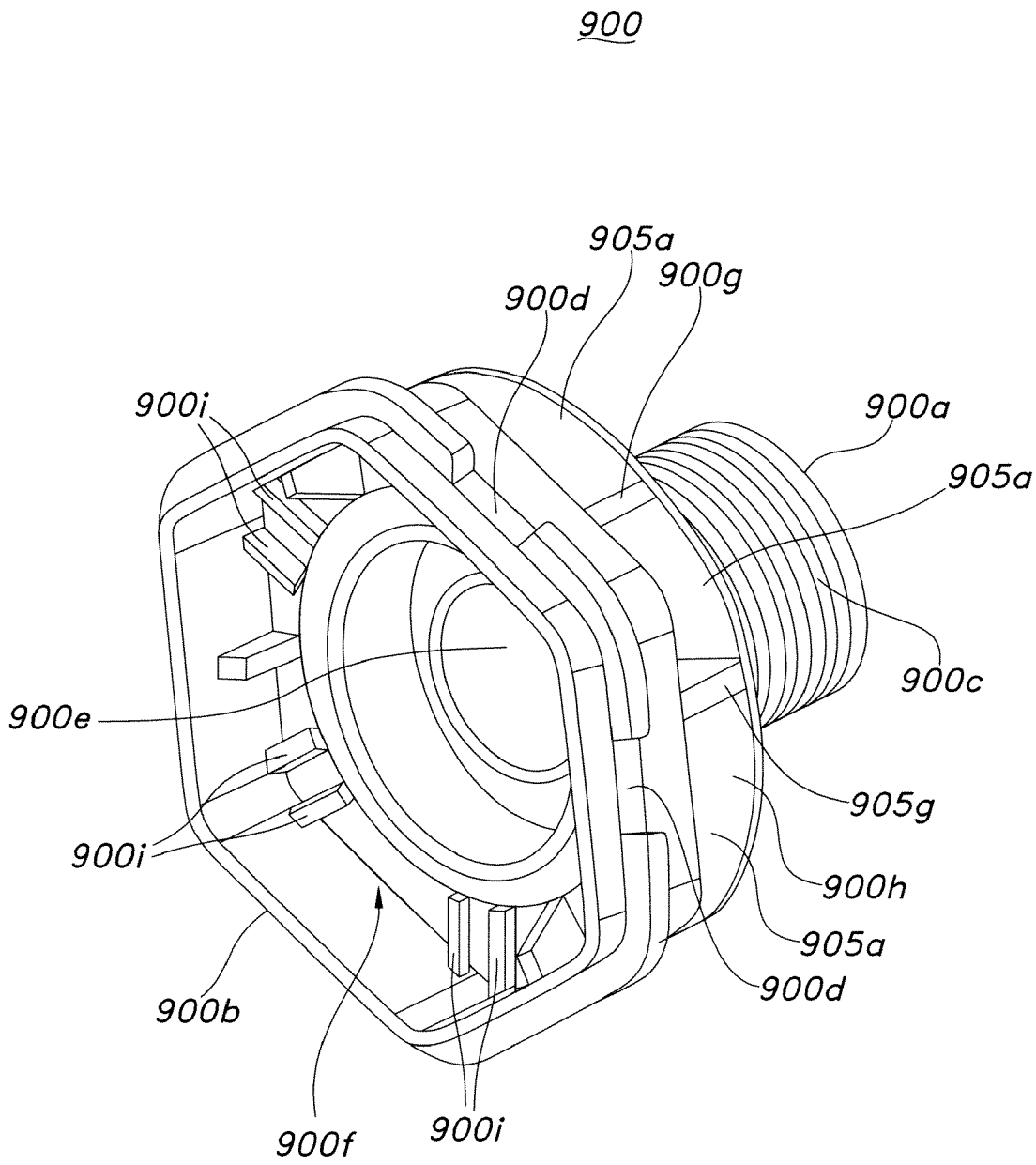
FIG. 9 is an isometric bottom view of a housing of a dual voltage switch, in accordance with certain exemplary embodiments.

In a fourth step of manufacturing the dual voltage switch, a housing (not shown) is coupled to the cover 310 via the snap features 310*a* of the cover 310. FIG. 9 is an isometric bottom view of a housing 900 of a dual voltage switch, in accordance with certain exemplary embodiments.

The housing 900 has a first end 900*a* configured to extend outside a transformer tank (not shown) and a second end 900*b* configured to extend inside the transformer tank. The first end 900*a* includes one or more grooves 900*c* about which an assembly nut (not shown) can be twisted to hold the housing 900 onto a tank wall of the transformer tank. In certain exemplary embodiments, a gasket (not shown) can be fitted about the first end 900*a* of the housing 900 for maintaining a mechanical seal between the tank wall and the housing 900. The second end 900*b* of the housing 900 includes notches 900*d* configured to receive snap features of a cover (not shown) of the dual voltage switch.

A channel 900*e* extends through the first end 900*a* and the second end 900*b* of the housing 900. The channel 900*e* is configured to receive a rotor (not shown) of the dual voltage switch. An interior profile 900*f* of the housing 900 corresponds to the rotor and the cover of the dual voltage switch.

The housing 900 includes multiple pockets 905*a* configured to receive dielectric fluid to increase dielectric capabilities and improve cooling of the switch contacts. For example, multiple pockets 905*a* can encircle the switch, between ribs 900*g*. The ribs 900*g* extend radially outward from the second end 900*b* of the housing 900 to an outside diameter of a round face 900*h* of the housing 900. For example, the housing 900 can include about six pockets 905*a*. The pockets 905*a* are configured to be filled with dielectric fluid to cool the housing 900 and the components contained therein, including the contacts (not shown), and to prevent dielectric breakdown. In certain exemplary embodiments, the dielectric fluid has greater dielectric strength and thermal conductivity than a plastic material, such as a polyethylene terephthalate (PET) polyester material, of the housing 900. Thus, the pockets can increase dielectric capability of the switch. This increased dielectric capability allows the switch to have a shorter length than traditional switches. For example, instead of using lengthy material to meet electric clearance and cooling goals, the switch uses shorter material with fluid-filled pockets.

With reference to FIGS. 8-9, when the housing 900 is coupled to the cover 310 (FIG. 8) via the snap features 310*a*, the stationary contacts 505-508 are constrained by support members 526*a* and 527*a* and support ribs 900*i* inside the housing 900. The support members 526*a* and 527*a* and support ribs 900*i* allow dielectric fluid to fill on both sides of the contacts 505-508, improving the cooling of the contacts 505-508.

In certain exemplary embodiments, the ribs 900*i* are offset from the ribs 900*g* so that a straight line path does not exist from the contacts 505-508 through both sets of ribs 900*g* and 900*i* to the transformer tank wall. The increased and tortuous path through the ribs 900*g* and 900*i* to the tank wall increases dielectric withstand and allows switch length to be reduced. For example, the length of the switch can be reduced because the ribs 900*g* and 900*i* force the electric path to travel the same "length" as in traditional switches, but portions of the path are disposed substantially perpendicular or angularly to the length of the switch.

Figure 10:
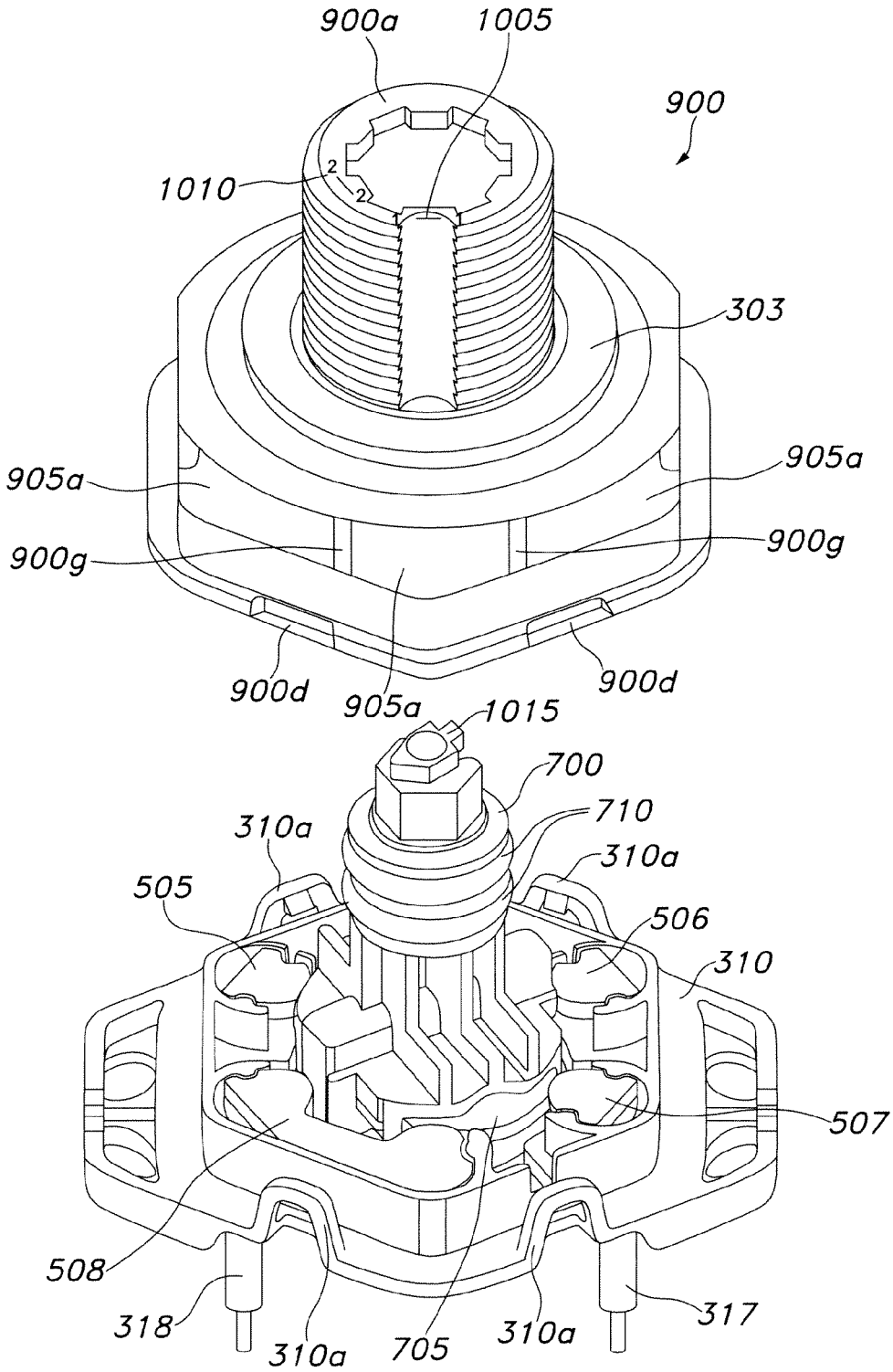
FIG. 10 is a perspective side view of a housing and a gasket aligned for assembly with stationary contacts, wires, a rotor, o-rings, and movable contact assemblies assembled within a cover of a dual voltage switch, in accordance with certain exemplary embodiments.
Figure 11:
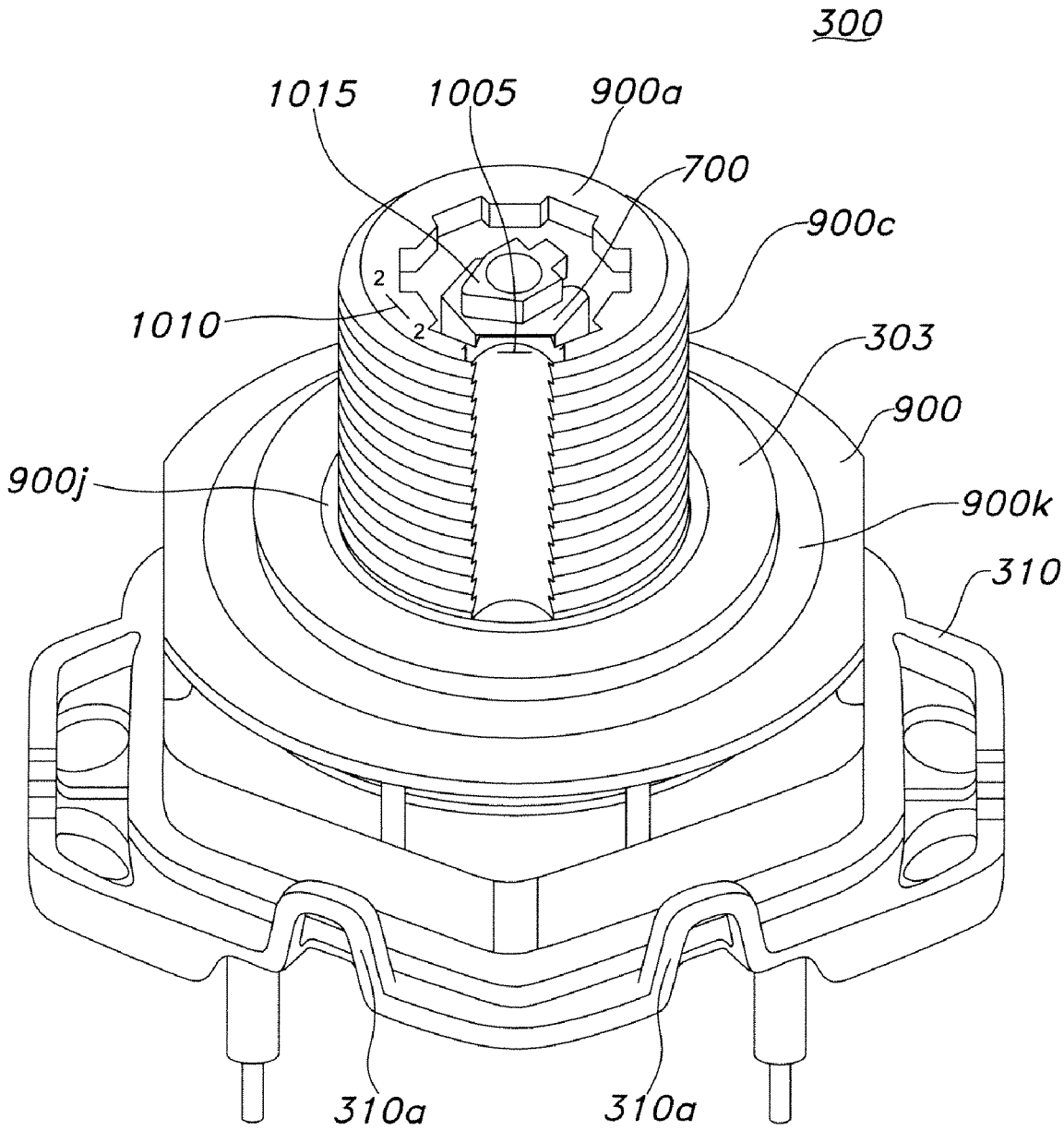
FIG. 11 is a perspective side view of an assembled dual voltage switch, in accordance with certain exemplary embodiments.

FIG. 10 is a perspective side view of the housing 900 and the gasket 303 aligned for assembly with the stationary contacts 505-508, wires 315-318, rotor 700, o-rings 710, and movable contact assemblies 705 assembled within the cover 310 of the dual voltage switch, in accordance with certain exemplary embodiments. FIG. 11 is a perspective side view of an assembled dual voltage switch 300, in accordance with certain exemplary embodiments.

With reference to FIGS. 10-11, the housing 900 of the assembled dual voltage switch 300 is disposed about the rotor 700, the movable contact assemblies 705, the stationary contacts 505-508, and the cover 310. The housing 900 is attached to the cover 310 via the snap features 310*a* of the cover 310. Each snap feature 310*a* engages a corresponding notch 900*d* of the housing 900.

The first end 900*a* of the housing 900 includes labels 1005 and 1010, which indicate whether the windings of the transformer being controlled by the dual voltage switch 300 have an in-series configuration or an in-parallel configuration. For example, label 1005 can correspond to an in-parallel configuration, and label 1010 can correspond to an in-series configuration. Rotation of the rotor 700 within the housing 900 causes an indicator 1015 of the rotor 700 to point to one of the labels 1005 and 1010. Thus, an operator viewing the indicator 1015 can determine the configuration of the windings without physically inspecting the windings or the movable contact-stationary contact pairings within the dual voltage switch 300.

A step member 900*j* is disposed at a bottom base of the grooves 900*c*, between the grooves 900*c* and the gasket 303. In certain exemplary embodiments, the step member 900*j* has an outer diameter that is slightly larger than an inner diameter of the gasket 303. Thus, the gasket 303 can be minimally stretched to be installed over the step member 900*j*. An interference fit between the gasket 303 and the step member 900*j* retains the gasket 303 in place when the switch 300 is being installed in a transformer tank.

The outer diameter of the step member 900*j* is large enough to retain the gasket 303, but not so large that it interferes with compression of the gasket 303. Improper compression of the gasket 303 could result in a transformer fluid leak. In certain exemplary embodiments, the height of the step member 900*j* above a face 900*k* of the housing 900 is about 70 percent of the thickness of the gasket 303. The outer diameter of the step member 900*j* is larger than the diameter of a hole in the transformer tank wall in which the switch 300 is installed. When the switch 300 is installed, the grooves 900*c* extend outside the transformer tank wall. An assembly nut (not shown) twists about the grooves 900*c*, drawing the step member 900*j* tight against the inside of the tank wall and compressing the gasket 303. The percentage of compression of the gasket 303 can vary depending on the material of the gasket. For example, a gasket made of Acrylonitrile-Butadiene (NBR) can be compressed by about 30 percent. The step member 900*j* prevents over compression or under compression of the gasket 303, either of which could result in seal failure.

Figure 12:
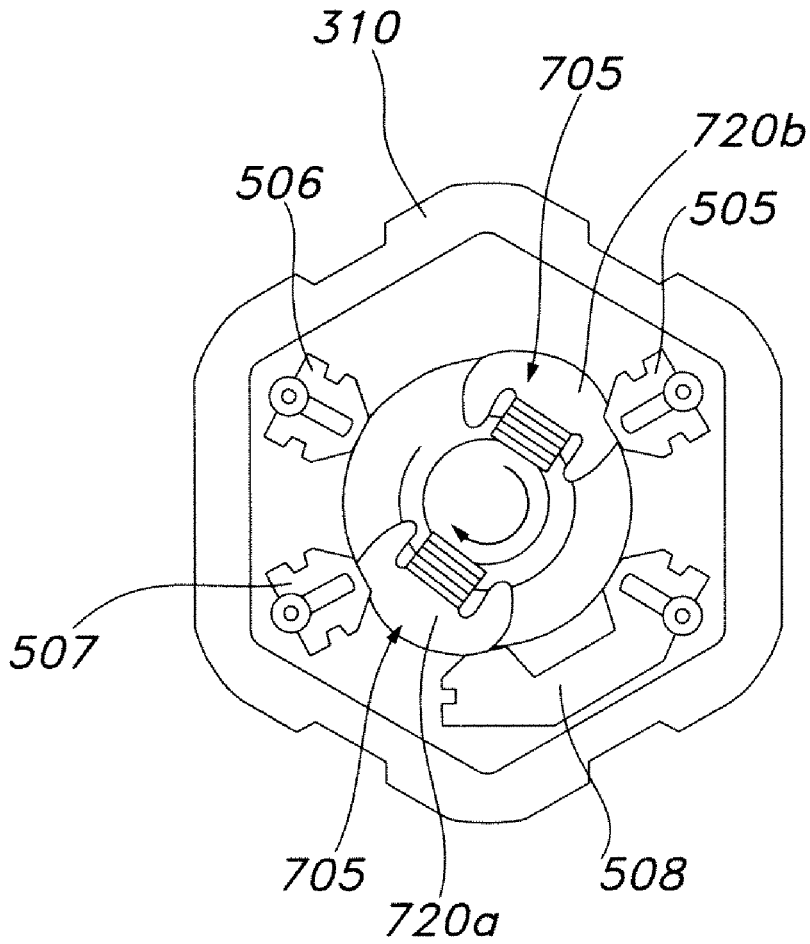
FIG. 12 is an elevational bottom view of movable contact assemblies in a first position relative to stationary contacts assembled within a cover of a dual voltage switch, in accordance with certain exemplary embodiments.
Figure 13:
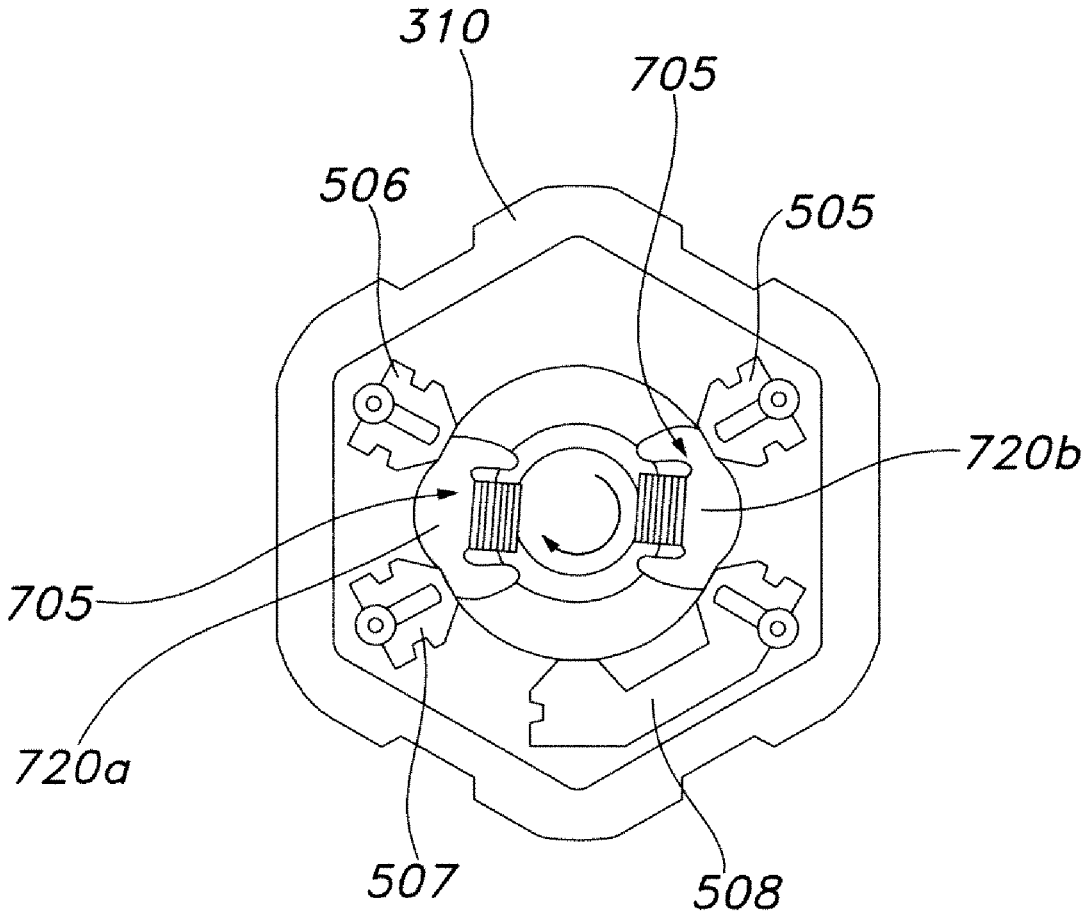
FIG. 13 is an elevational bottom view of movable contact assemblies in a second position relative to stationary contacts assembled within a cover of a dual voltage switch, in accordance with certain exemplary embodiments.

FIG. 12 is an elevational bottom view of movable contact assemblies 705 in a first position relative to stationary contacts 505-508 assembled within a cover 310 of a dual voltage switch, in accordance with certain exemplary embodiments. FIG. 13 is an elevational bottom view of the movable contact assemblies 705 in a second position relative to the stationary contacts 505-508.

Each position corresponds to a different electrical configuration of the transformer being controlled by the dual voltage switch. For example, the first and second positions can correspond to in-series and in-parallel configurations, respectively, of the windings of the transformer. Thus, each position can correspond to a different voltage of the transformer.

In the first position, movable contact 720*a* is electrically coupled to stationary contacts 507 and 508, and movable contact 720*b* is electrically coupled to stationary contact 505. In the second position, movable contact 720*b* is electrically coupled to stationary contacts 505 and 508, and movable contact 720*b* is electrically coupled to stationary contacts 506 and 507. Exemplary circuit diagrams illustrating circuits corresponding to the first and second positions are discussed below, with reference to FIGS. 31-32.

Figure 14:
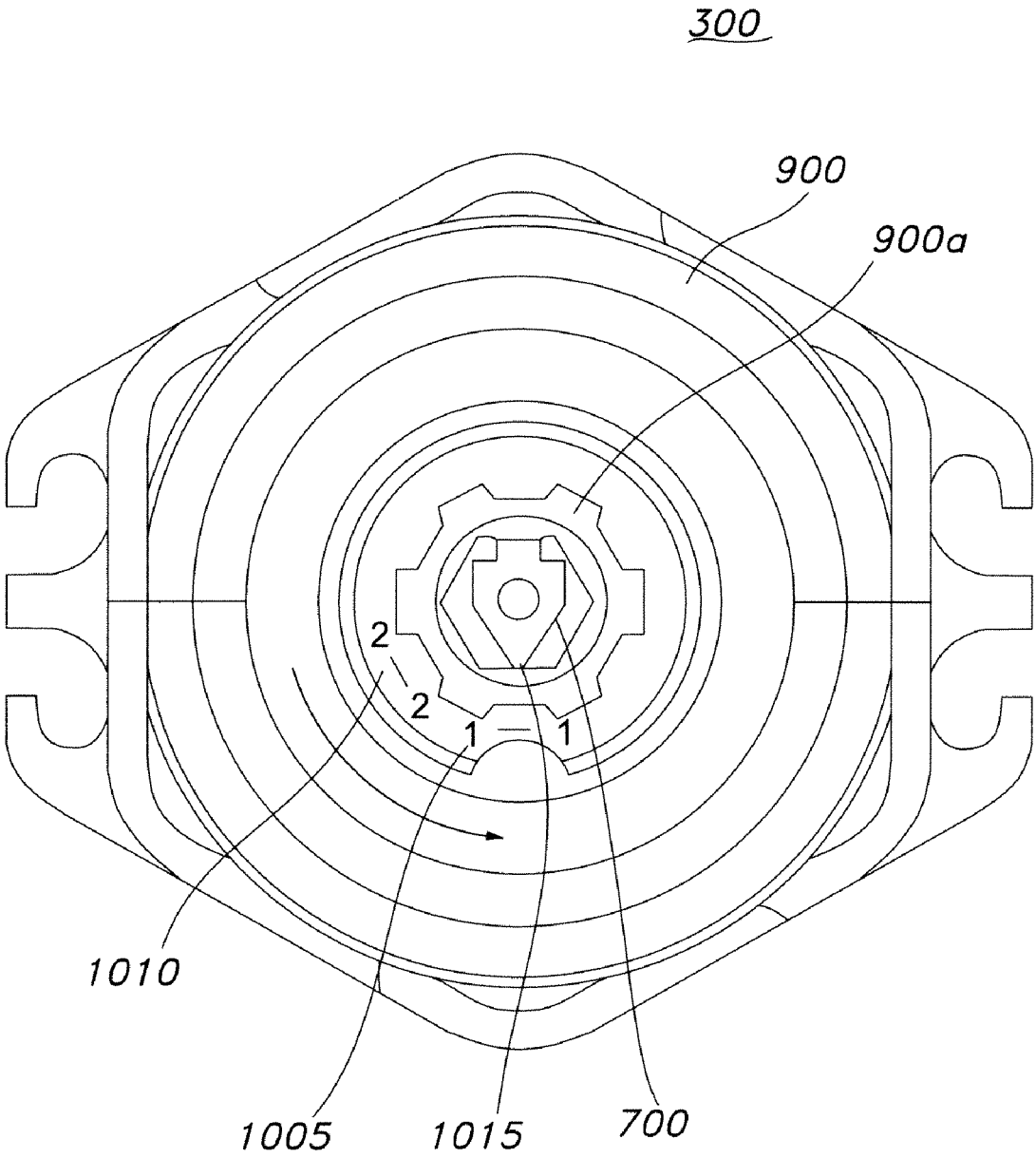
FIG. 14 is an elevational top view of a dual voltage switch in a first position, in accordance with certain exemplary embodiments.
Figure 15:
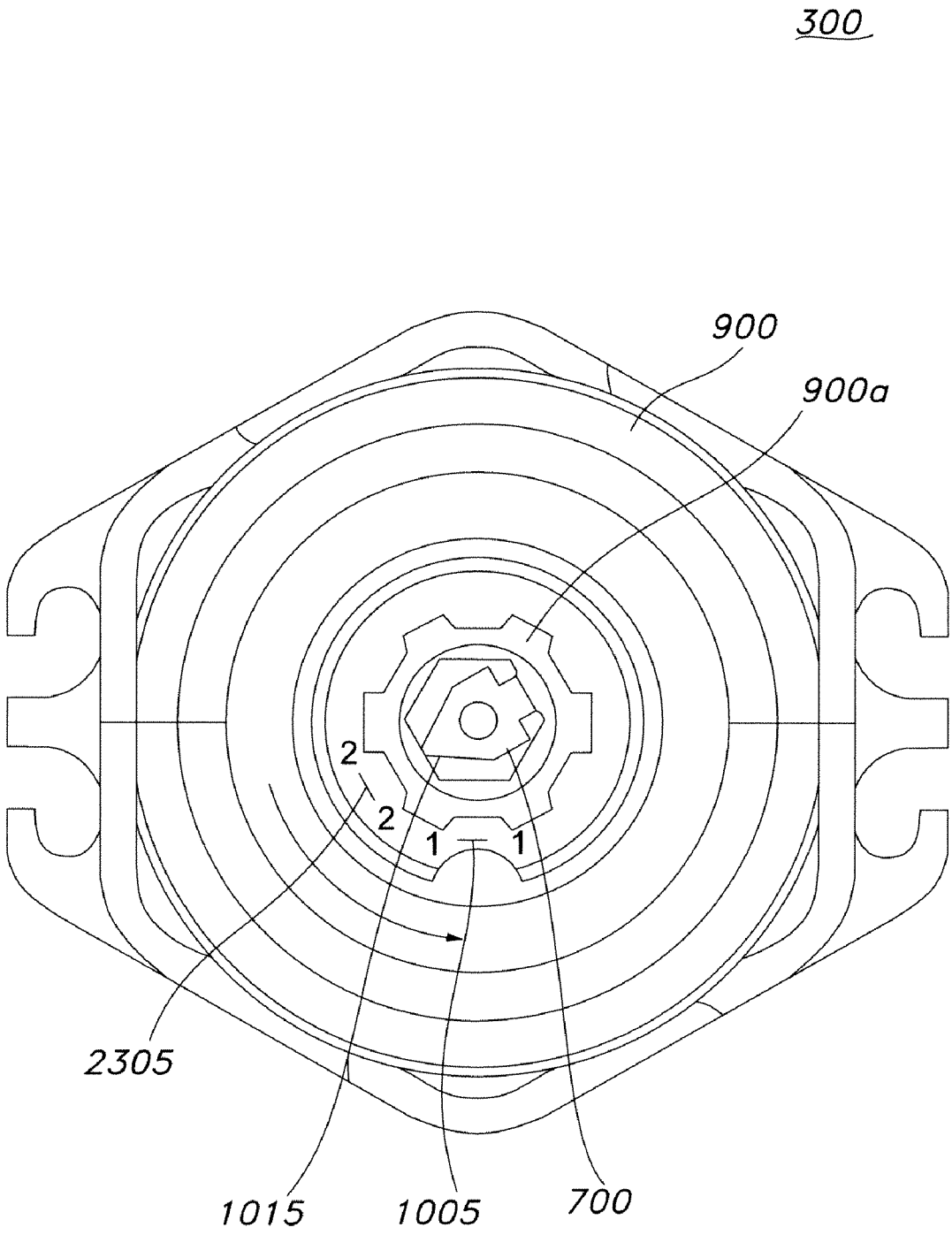
FIG. 15 is an elevational top view of a dual voltage switch in a second position, in accordance with certain exemplary embodiments.

FIG. 14 is an elevational top view of the dual voltage switch 300 in the first position, in accordance with certain exemplary embodiments. FIG. 15 is an elevational top view of the dual voltage switch 300 in the second position, in accordance with certain exemplary embodiments. With reference to FIGS.

12-15, the first end 900*a* of the housing 900 of the dual voltage switch 300 includes labels 1005 and 1010, which indicate the position of the movable contact assemblies relative to the stationary contacts 505-508. Label "1-1" 1005 corresponds to the first position of the movable contact assemblies 705 in FIG. 13, and label "2-2" 1010 corresponds to the second position of the movable contact assemblies 705 in FIG. 12.

Rotation of the rotor 700 within the housing 900 causes an indicator 1015 of the rotor 700 to point to one of the labels 1005 and 1010. Thus, an operator viewing the indicator 1015 can determine the configuration of the windings without physically inspecting the windings or the movable contact-stationary contact pairings within the dual voltage switch 300. In certain exemplary embodiments, the operator can rotate a handle (not shown) coupled to the rotor 700 to change the position from the first position to the second position or vice versa. In certain exemplary embodiments, the stationary contacts 505-508 and the wires that are connected to the contacts 505-508 are identified by labels 2005 (shown on FIG. 3) on the outside of the cover 310 of the switch 300. These labels 2005 can aid an operator assembling the switch 300 to correctly wire the switch 300 with respect to the labels 1005, 1010 on the front of the housing 900.

Figure 16:
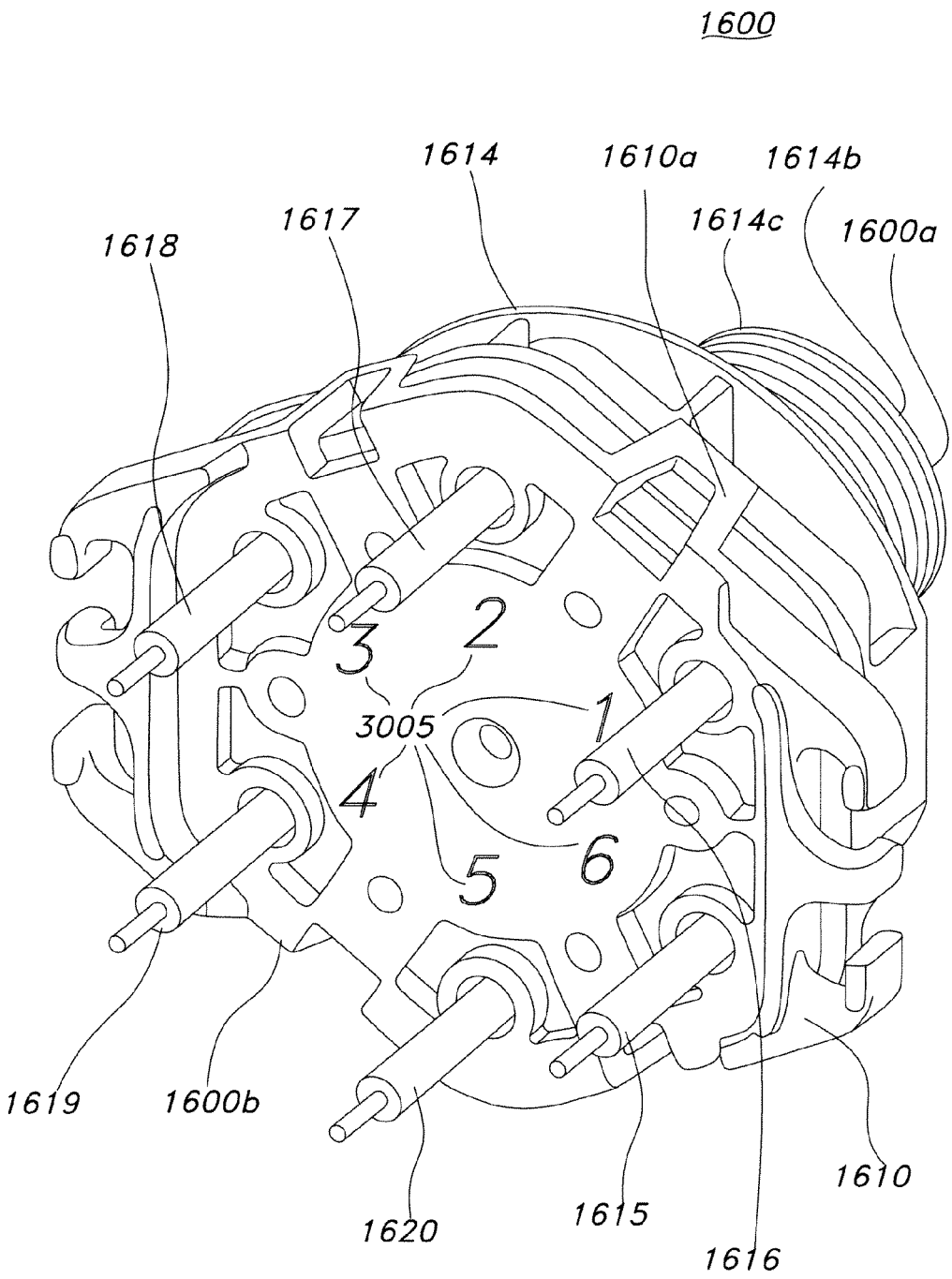
FIG. 16 is an isometric bottom view of a tap changer, in accordance with certain exemplary embodiments.
Figure 17:
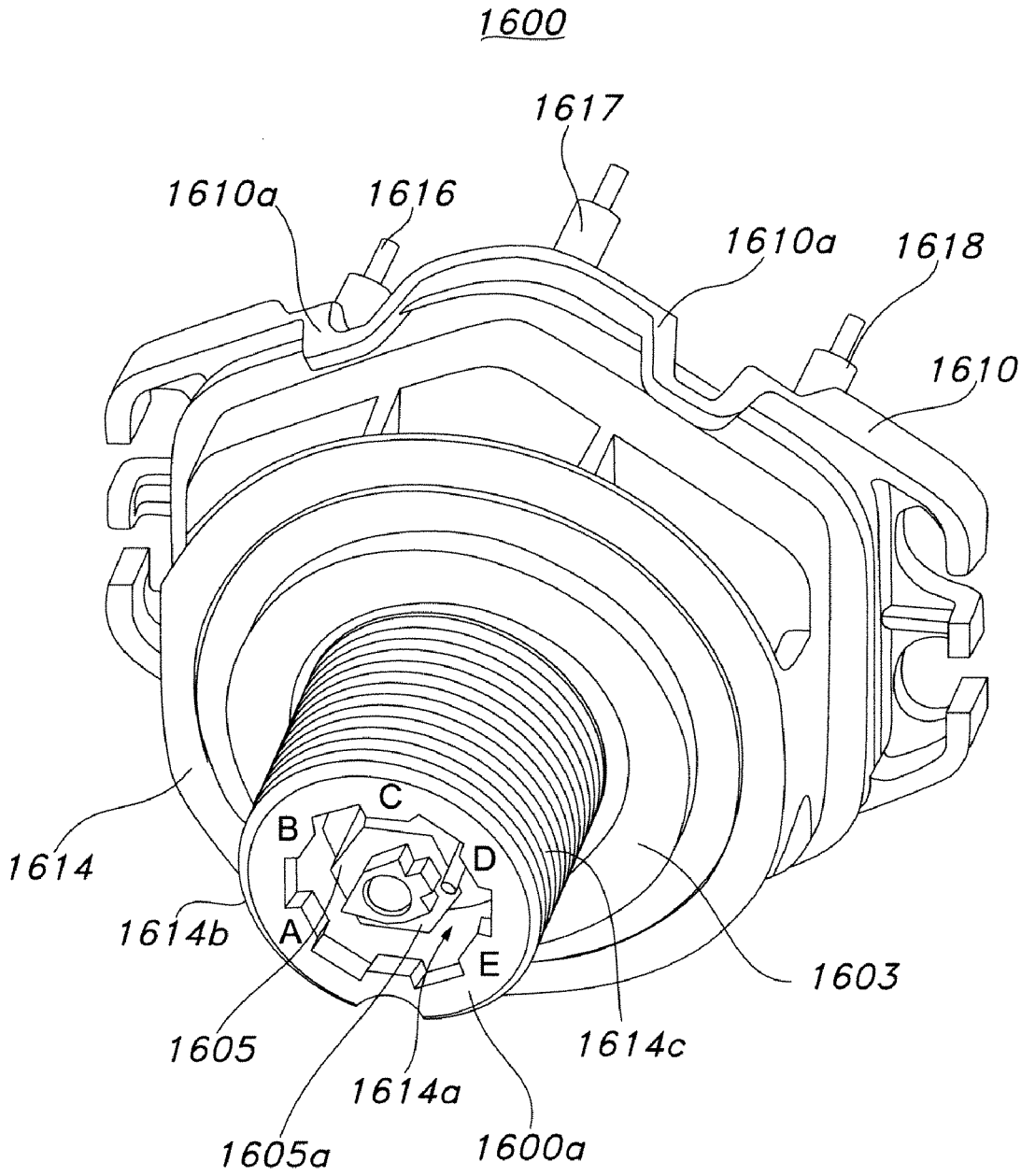
FIG. 17 is an isometric top view of a tap changer, in accordance with certain exemplary embodiments.

FIG. 16 is an isometric bottom view of a tap changer 1600, in accordance with certain exemplary embodiments. FIG. 17 is an isometric top view of the tap changer 1600 and a flat cylindrical gasket 1603, in accordance with certain exemplary embodiments. The tap changer 1600 is configured to alter the voltage of a transformer (not shown) electrically coupled thereto by changing the turn ratio of the transformer windings.

As with the switch 120 depicted in FIG. 2 and the dual voltage switch 300 depicted in FIGS. 3-15, the tap changer 1600 includes an elongated rotor 1605 disposed between a cover 1610 and a housing 1614 of the tap changer 1600. The cover 1610 is removably coupled to the housing 1614 via one or more snap features 1610*a* of the cover 1610. In certain alternative exemplary embodiments, the housing 1614 can include the snap feature(s) 1610*a*. Each of the housing 1614 and the cover 1610 is at least partially molded from a non-conductive material, such as a non-conductive plastic.

The rotor 1605 is disposed within an interior channel 1614*a* of the housing 1614 and is essentially sandwiched between an interior surface of the cover 1610 and the interior channel 1614*a* of the housing 314. Two o-rings (not shown) are disposed about a portion of the rotor 1605, within the interior channel 1614*a*. The o-rings are configured to maintain a mechanical seal between the housing 1614, and the rotor 1605.

In operation, a first end 1600*a* of the tap changer 1600, including an upper portion 1614*b* of the housing 1614 and an upper portion 1605*a* of the rotor 1605, is disposed outside the transformer tank (not shown), and a second end 1600*b* of the tap changer 1600, including the remaining portions of the housing 1614 and the rotor 1605, the gasket 1603, the cover 1610, certain stationary contacts (not shown) coupled to the cover 1610, a movable contact assembly (not shown) coupled to the rotor 1605, and certain wires 1615-1620 electrically coupled to the stationary contacts, is disposed inside the transformer tank. The upper portion 1614*b* of the housing 1614 includes grooves 1614*c*. In certain exemplary embodiments, an assembly nut (not shown) can be twisted about the grooves 1614*c* to attach the switch 1600 to a transformer tank wall (not shown) and to compress the gasket 1603.

The stationary contacts and wires 1615-1620 are electrically coupled to one another via sonic welding, male and female quick connect terminals, or other suitable means known to a person of ordinary skill in the art having the benefit of this disclosure. The wires 1615-1620 extend from the stationary contacts and are each electrically coupled to one or more windings of the transformer. As described in more detail hereinafter, with reference to FIGS. 25-26, movement of the movable contact relative to the stationary contacts alters a voltage of the transformer by changing an electrical configuration of the windings. For example, a first arrangement of the stationary and movable contacts can correspond to a first turn ratio of the windings, and a second arrangement of the stationary and movable contacts can correspond to a second turn ratio of the windings. In certain exemplary embodiments, an operator can rotate a handle (not shown) coupled to the rotor 1605 to move the movable contact relative to the stationary contacts.

Figure 18:
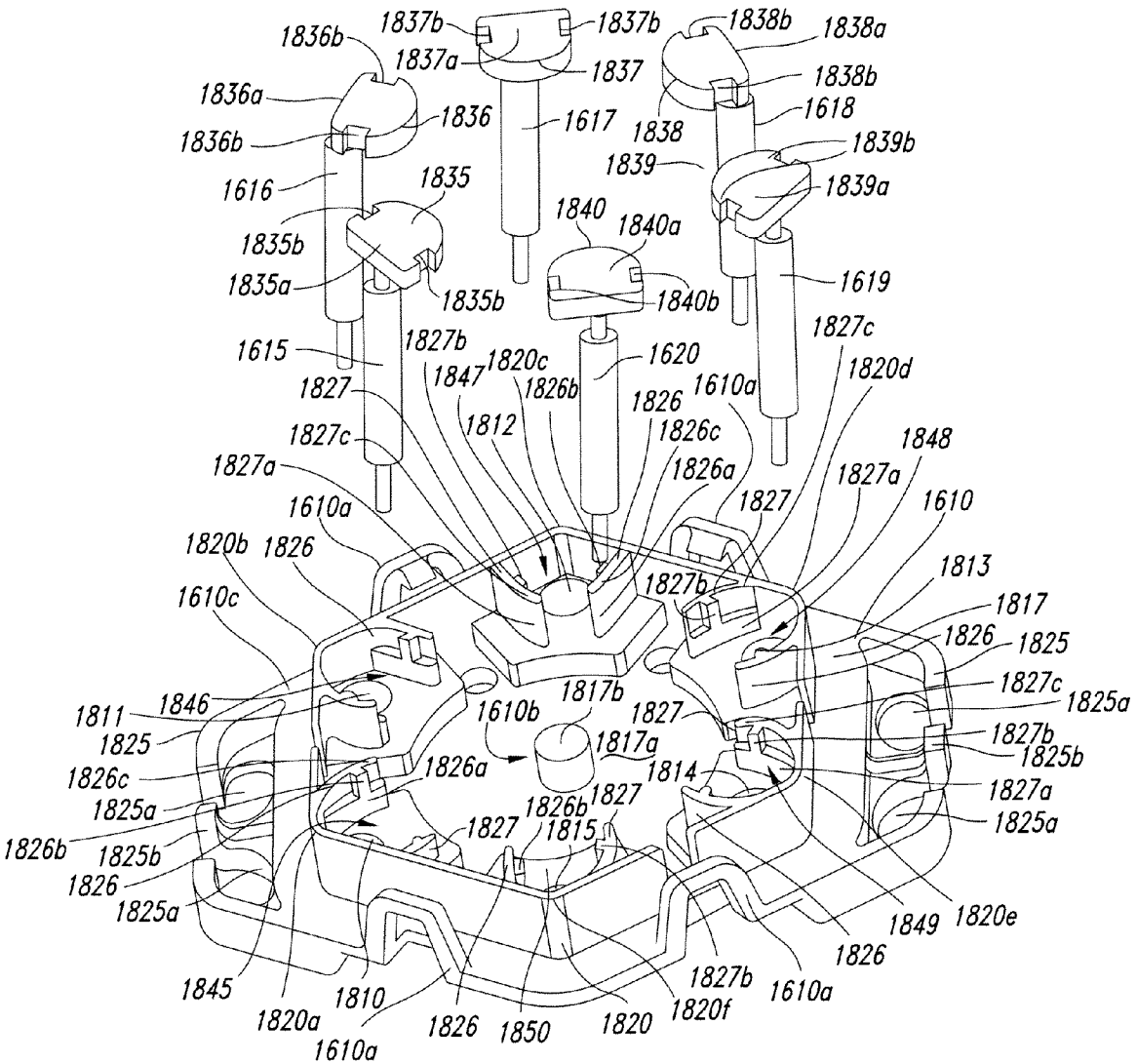
FIG. 18 is an exploded perspective side view of a cover, stationary contacts, and wires of a tap changer, in accordance with certain exemplary embodiments.

A method of manufacturing the tap changer 1600 will now be described with reference to FIGS. 18-24. FIG. 18 is an exploded perspective side view of the cover 1610, the stationary contacts 1835-1840, and the wires 1615-1620 of the tap changer 1600, in accordance with certain exemplary embodiments. In a first step, the stationary contacts 1835-1840 and the wires 1615-1620 electrically coupled thereto are aligned with stationary contact holes 1810-1815 in the cover 1610.

The cover 1610 includes a base member 1817, a hexagon-shaped wall member 1820, and a pair of wire guide members 1825. The base member 1817 is substantially hexagonal-shaped, with a substantially circular inner region 1817*a*. The base member 1817 includes the snap features 1610*a* of the cover 1610. The snap features 1610*a* are configured to engage a side surface of a housing (not shown) of the tap changer, as described hereinafter with reference to FIGS. 23-24. The base member 1817 also includes a protrusion 1817*b* configured to receive a notch of a rotor (not shown) of the tap changer, as described hereinafter with reference to FIG. 20.

The wire guide members 1825 include apertures 1825*a* and a notch 1825*b* for wrapping one or more of the wires 1615-1620 about the cover 1610. Thus, the wire guide members 1825 are configured to retain the wires 1615-1620 within the transformer tank. The integral wire guide members 1825 can eliminate the need for separate wire guides attached to a core clamp of the transformer, as in traditional switches. In certain alternative exemplary embodiments, the cover 1610 may not include wire guide members 1825.

The hexagon-shaped wall member 1820 extends substantially perpendicularly from a surface 1817*c* of the base member 1817 and thereby defines an interior space 1610*b* of the cover 1610. The stationary contact holes 1810-1815 are disposed within the base member 1817, proximate corners 1820*a*-1820*f*, respectively, of the hexagon-shaped wall member 1820.

A pair of elongated members 1826-1827 are disposed on opposite sides of each of the contact holes 1810-1815. Each elongated member 1826, 1827 includes a support member 1826*a*, 1827*a*, a protrusion 1826*b*, 1827*b*, and an upper member 1826*c*, 1827*c*. The elongated members 1826-1827, the base member 1817, and the hexagon-shaped wall member 1820 define pockets 1845-1850 in the cover 1610, wherein each pocket 1845-1850 is configured to receive a stationary contact 1835-1840.

Each of the stationary contacts 1835-1840 includes an electrically conductive material, such as copper. Each of the stationary contacts 1835-1840 is a "single button" contact with a single, substantially semi-circular member 1835*a*, 1836*a*, 1837*a*, 1838*a*, 1839*a*, 1840*a* having a pair of notches 1835*b*, 1836*b*, 1837*b*, 1838*b*, 1839*b*, 1840*b* disposed on opposite sides thereof. In certain alternative exemplary embodiments described in more detail hereinafter with reference to FIG. 29, one or more of the stationary contacts 1835-1840 can include a pointed member in place of the semi-circular member 1835*a*, 1836*a*, 1837*a*, 1838*a*, 1839*a*, 1840*a* to increase electrical clearance between neighboring contacts 1835-1840. Each notch 1835*b*, 1836*b*, 1837*b*, 1838*b*, 1839*b*, 1840*b* is configured to slidably engage a corresponding protrusion 1826*b*, 1827*b* of the elongated member 1826, 1827 disposed proximate thereto.

The stationary contacts 1835-1840 are electrically coupled to the wires 1615-1620, respectively via sonic welding, male and female quick connect terminals, or other suitable means known to a person of ordinary skill in the art having the benefit of this disclosure. For example, the wires 1615-1620 can be sonic welded to bottom surfaces of semi-circular members 1835*a*, 1836*a*, 1837*a*, 1838*a*, 1839*a*, and 1840*a* respectively.

Figure 19:
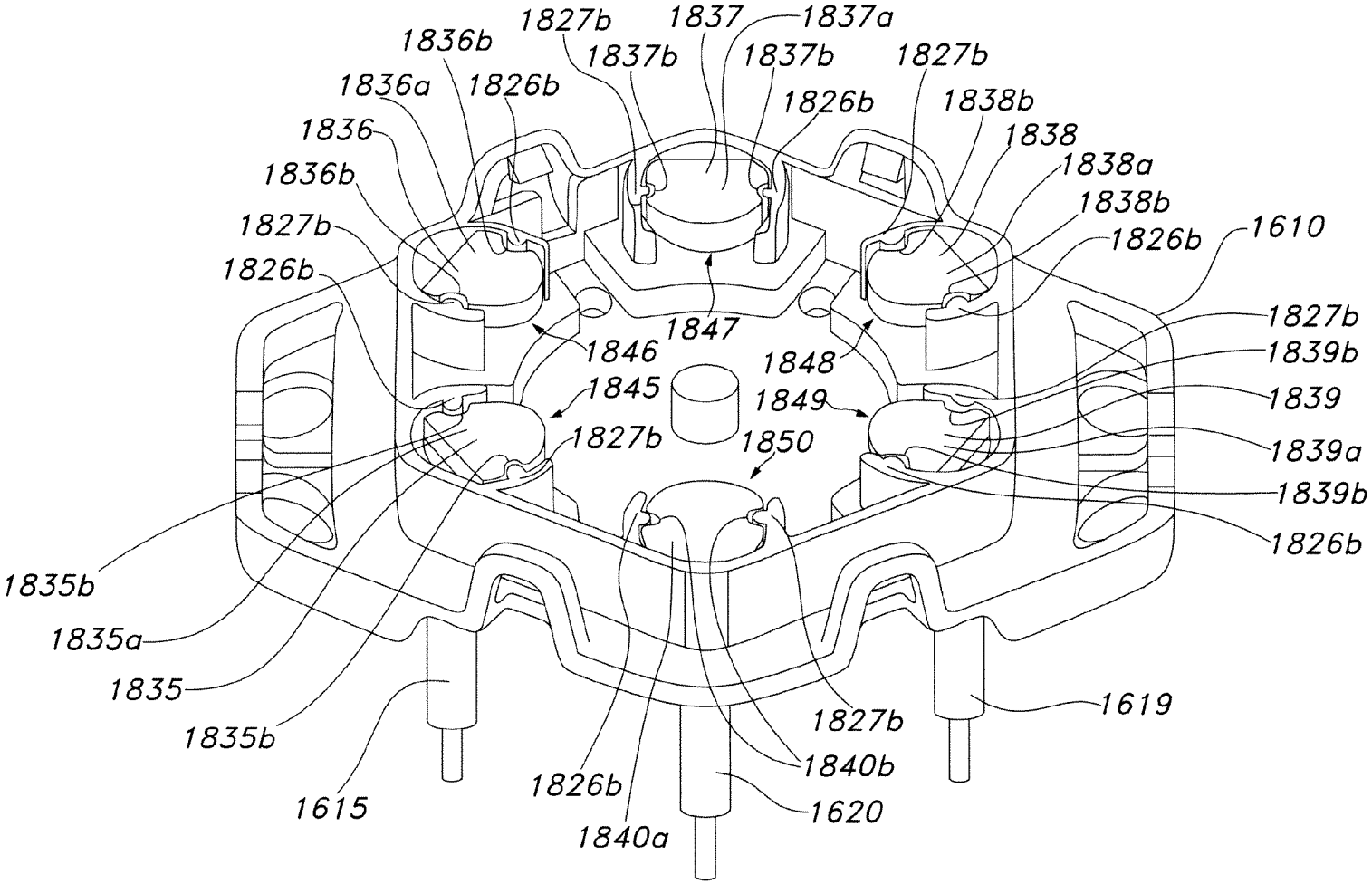
FIG. 19 is a perspective side view of a stationary contacts and wires assembled within a cover of a tap changer, in accordance with certain exemplary embodiments.

In a second step of manufacturing the tap changer 1600, the stationary contacts 1835-1840 are inserted into the pockets 1845-1850 of the cover 1610, as illustrated in FIG. 19. With reference to FIGS. 18 and 19, a bottom surface of each stationary contact 1835-1840 rests on the support members 1826*a*, 1827*a* of the elongated members 1826-1827 disposed proximate thereto; side surfaces of each stationary contact 1835-1840 engage the upper members 1826*c*-1827*c* of the elongated members 1826-1827 disposed proximate thereto; and the notches 1835*b*, 1836*b*, 1837*b*, 1838*b*, 1839*b*, and 1840*b* of each stationary contact 1835-1840 engage the protrusions 1826*b*-1827*b* of the elongated members 1826-1827 disposed proximate thereto. Thus, the stationary contacts 1835-1840 are suspended from the base member 1817, with gaps being disposed below the stationary contacts 1835-1840 and between the contacts 1835-1840 and the wall member 1820. The gaps are configured to be filled with dielectric fluid to cool the contacts 1835-1840 and the wires 1615-1620 and to prevent dielectric breakdown. The gaps also provide clearance for the contacts 1835-1840 and wires 1615-1620.

The wires 1615-1620 electrically coupled to the stationary contacts 1835-1840 extend through the stationary contact holes 1810-1815 in the cover 1610. Each wire 1615-1620 may be electrically coupled to one or more windings (not shown) of a transformer (not shown) to be controlled by the tap changer containing the cover 1610, stationary contacts 1835-1840, and wires 1615-1620.

Each pocket 1845-1850, hole, and space within the cover 1610, including the interior space 1610*b*, is configured to allow ingress and/or egress of dielectric fluid. The dielectric fluid can provide greater isolation between the stationary contacts 1835-1840, the movable contact (not shown), and the metal walls of the transformer tank.

Figure 20:
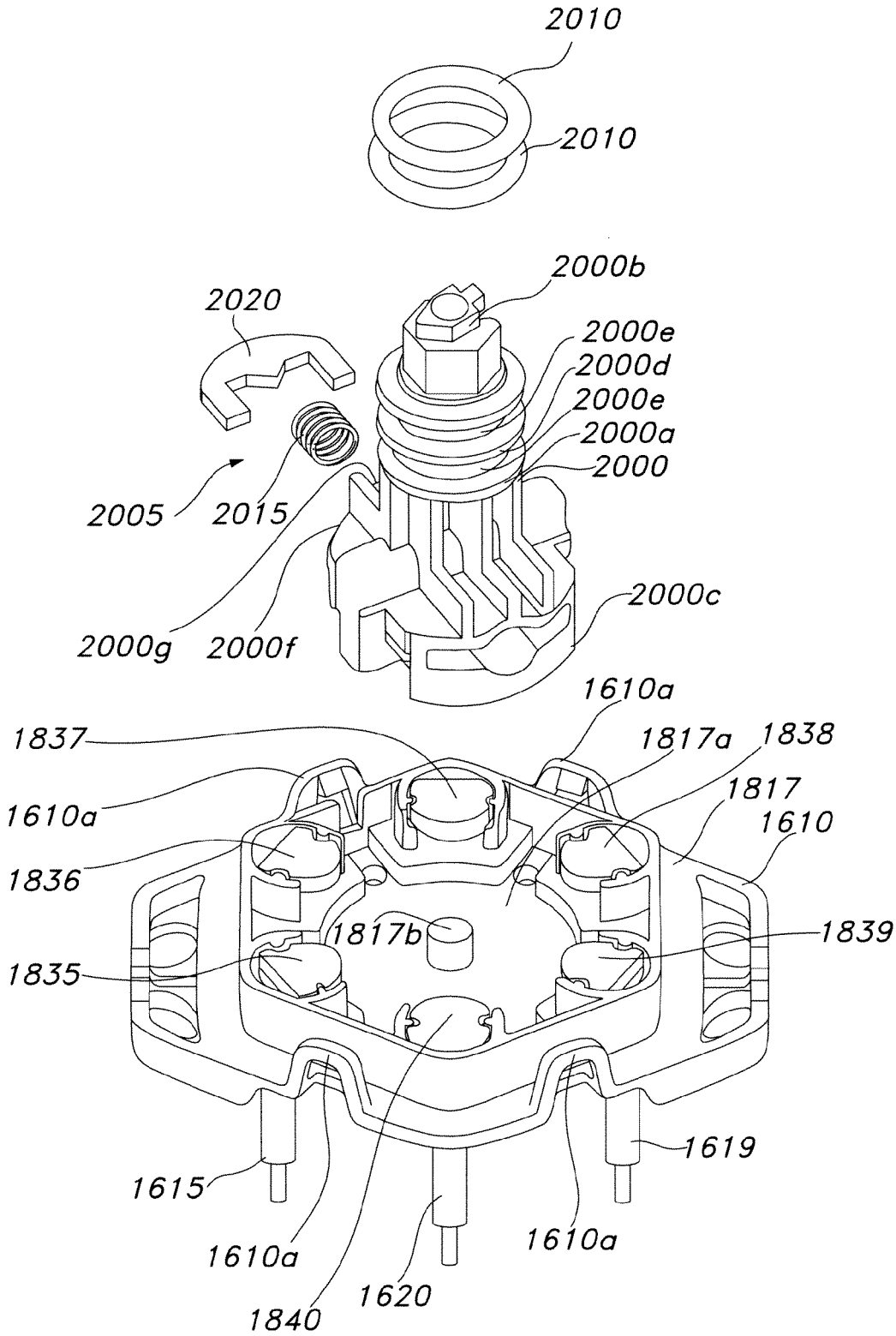
FIG. 20 is a partially exploded perspective side view of a cover, stationary contacts, wires, a movable contact assembly, a rotor, and o-rings of a tap changer, in accordance with certain exemplary embodiments.

In a third step of manufacturing the tap changer 1600, a rotor 2000, a movable contact assembly 2005, and a pair of o-rings 2010 are coupled to the cover 1610. FIG. 20 is a partially exploded perspective side view of the cover 1610, the stationary contacts 1835-1840, the wires 1615-1620, the rotor 2000, the movable contact assembly 2005, and the o-rings 2010, in accordance with certain exemplary embodiments.

The rotor 2000 includes an elongated member 2000*a* having a top end 2000*b*, a bottom end 2000*c*, and a middle portion 2000*d*. The top end 2000*b* has a substantially hexagonal-shaped cross-sectional geometry. The middle portion 2000*d* of the rotor 2000 has a substantially circular cross-sectional geometry with round grooves 2000*e* configured to receive the o-rings 2010. The o-rings 2010 are configured to maintain a mechanical seal between the rotor 2000 and the switch housing (not shown). For example, the o-rings 2010 may include nitrile rubber or fluorocarbon members.

The bottom end 2000*c* of the rotor 2000 has a substantially circular cross-sectional geometry, which corresponds to shape of the inner region 1817*a* of the base member 1817. The bottom end 2000*c* includes a notch (not shown) configured to receive the protrusion 1817*b* of the base member 1817. The rotor 2000 is configured to rotate about the protrusion 1817*b*.

The movable contact assembly 2005 is coupled to a side 2000*f* of the rotor 2000, proximate the bottom end 2000*c*. The movable contact assembly 2005 includes a spring 2015 and a movable contact 2020. The movable contact 2020 includes an electrically conductive material, such as copper. In certain exemplary embodiments, the movable contact 2020 is silver plated to provide extra protection against coaking.

The movable contact assembly 2005 extends perpendicularly from the side 2000*f* of the rotor 2000, with the spring 2015 being disposed between the rotor 2000 and the movable contact 2020 of the assembly 2005. The spring 2015 and at least a portion of the movable contact 2020 are disposed within a recess 2000*g* in the side 2000*f* of the rotor 2000. To install the rotor 2000 and movable contact assembly 2005 in the switch 1600, the movable contact 2020 is pushed back into the recess 2000*g*, thereby compressing the spring 2015. While the movable contact 2020 is depressed and the spring 2015 is still compressed, the rotor 2000 is set in place on the protrusion 1817*b*. The movable contact 2020 is then released and comes in contact with one or more of the stationary contacts 1835-1840.

The spring 2015 remains partially compressed, causing contact pressure between the stationary and movable contacts. The contact pressure can cause the rotor 2000 to be retained within the cover 1610 until a corresponding housing (2200 in FIG. 22) can be snapped into place. The contact pressure also can help to electrically couple the contacts by allowing current to flow between the contacts. High contact pressure can reduce electrical heating of the contacts, but also can make it more difficult to rotate the rotor can cause breakage of the rotor 2000 or cover 1610 if those forces exceed the mechanical strength of the components of the switch. An appropriate amount of contact pressure can be achieved by balancing these concerns and selecting component materials and mechanical relationships between the component materials that comply with specifications for maximum contact operating temperatures and switch operating torque.

Rotation of the rotor 2000 about the protrusion 1817*b* causes similar rotational movement of the movable contact assembly 2005. That rotation causes the movable contact 2020 of the movable contact assembly 2005 to move relative to one or more of the stationary contacts 1835-1840 disposed within the cover 1610. As described in more detail hereinafter, with reference to FIGS. 27-28, movement of the movable contact 2020 relative to the stationary contacts 1835-1840 alters a voltage of the transformer by changing an electrical configuration (in other words, a turn ratio) of the windings. In certain exemplary embodiments, an operator can rotate a handle (not shown) coupled to the rotor 2000 to move the movable contact 2020 relative to the stationary contacts 1835-1840.

Figure 21:
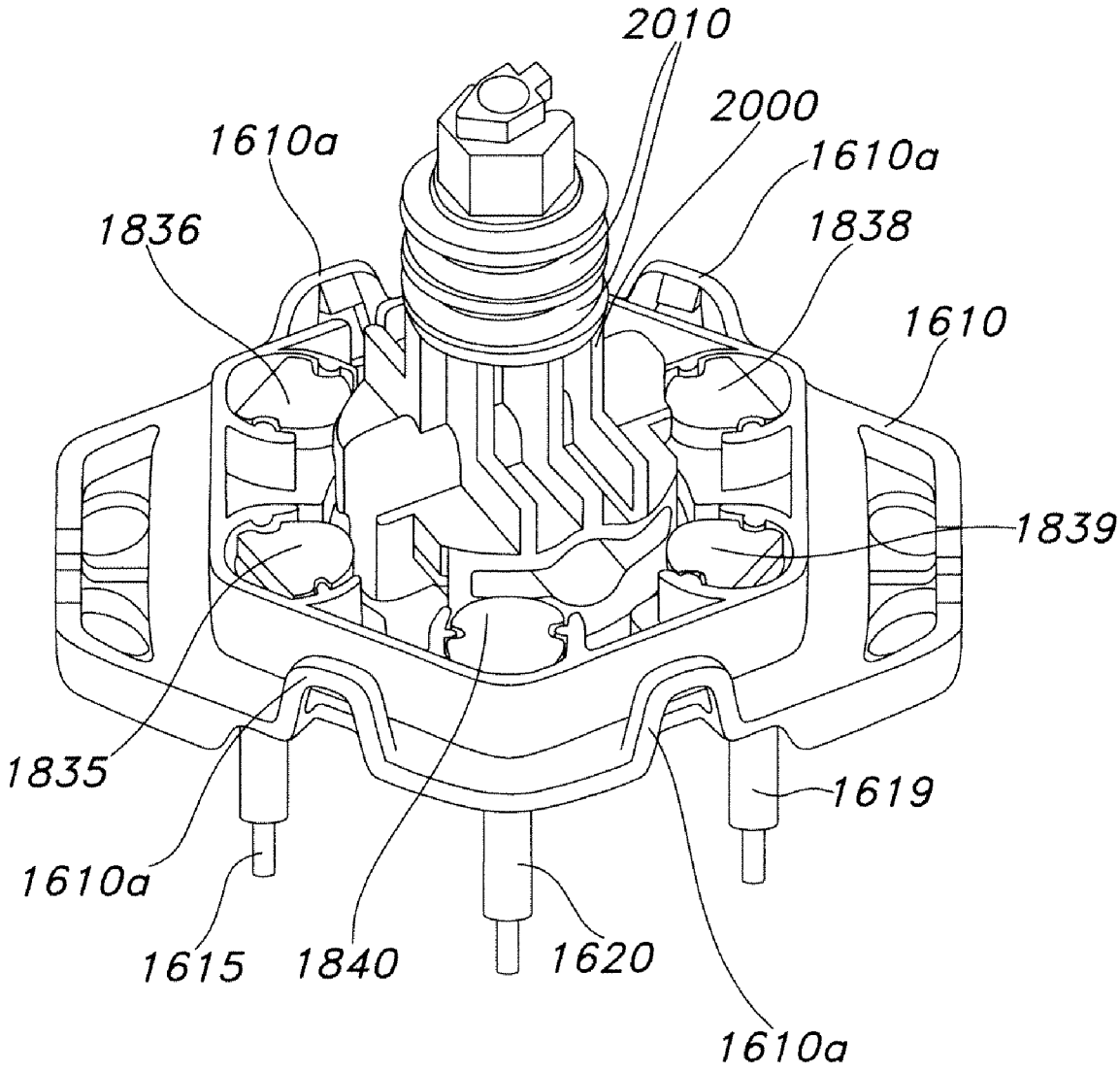
FIG. 21 is a perspective side view of stationary contacts, wires, a rotor, o-rings, and a movable contact assembly assembled within a cover of a tap changer, in accordance with certain exemplary embodiments.

FIG. 21 is a perspective side view of the stationary contacts 1835-1840, the wires 1615-1620, the rotor 2000, and the o-rings 2010 assembled within the cover 1610 of the tap changer 1600, in accordance with certain exemplary embodiments. With reference to FIGS. 20-21, the o-rings 2010 are disposed about the round grooves 2000*e* in the middle portion 2000*d* of the rotor 2000. The bottom end 2000*c* of the rotor 2000 is resting on the inner region 1817*b* of the base member 1817, with the notch of the rotor 2000 being rotatably disposed about the protrusion 1817*b* of the base member 1817.

The spring 2015 and at least a portion of the movable contact 2020 are disposed within the recess 2000*g* in the side 2000*f* of the rotor 2000. An outer edge of the movable contact 2020 is biased against, and thereby electrically coupled to, at least one of the stationary contacts 1835-1840. In FIG. 21, the movable contact 2020 (not shown) is electrically coupled to stationary contacts 1836 and 1837 (not shown).

Figure 22:
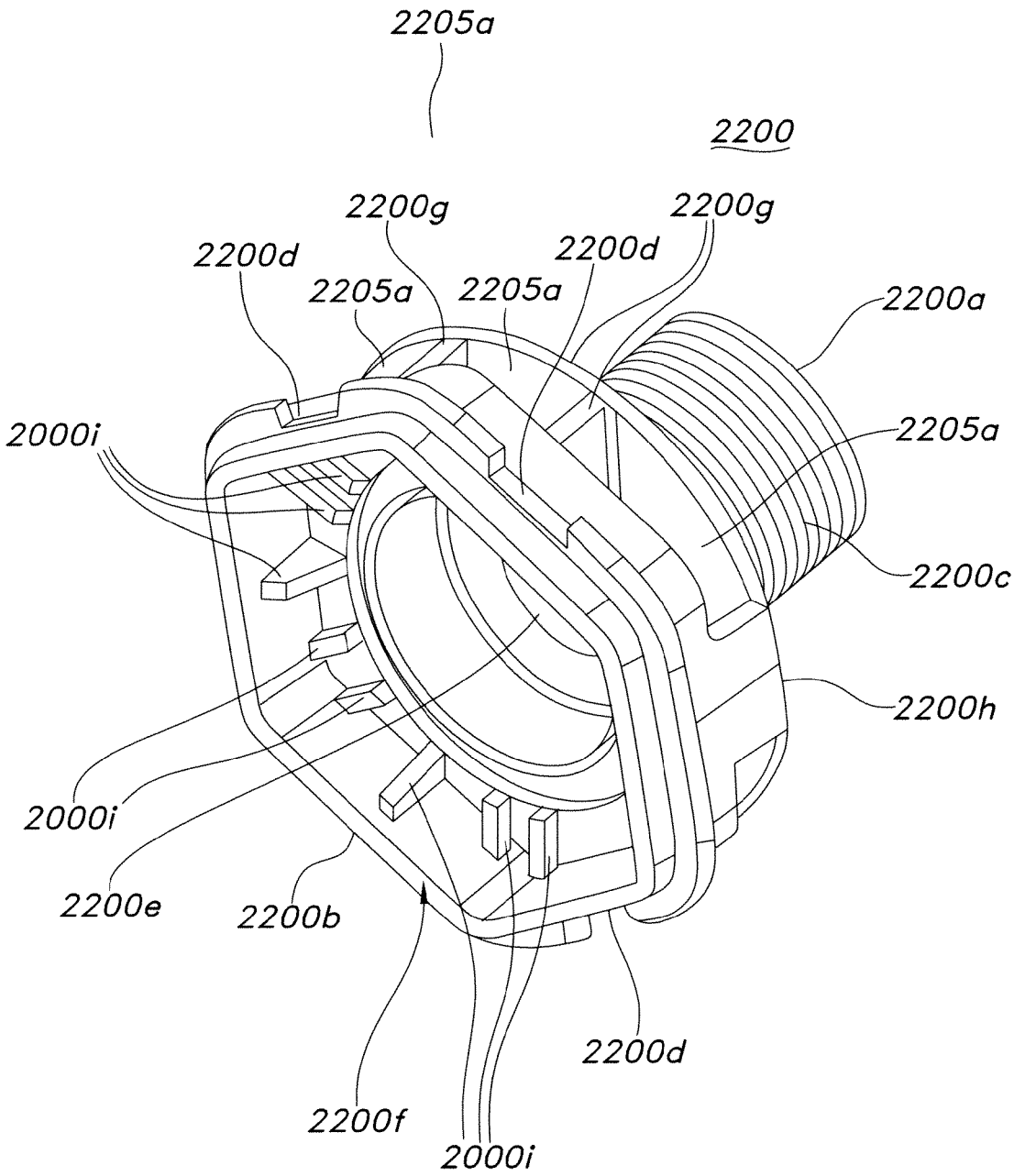
FIG. 22 is an isometric bottom view of a housing of a tap changer, in accordance with certain exemplary embodiments.

In a fourth step of manufacturing the tap changer 1600, a housing (not shown) is coupled to the cover 1610 via the snap features 1610*a* of the cover 1610. FIG. 22 is an isometric bottom view of a housing 2200 of a tap changer, in accordance with certain exemplary embodiments.

The housing 2200 has a first end 2200*a* configured to extend outside a transformer tank (not shown) and a second end 2200*b* configured to extend inside the transformer tank. The first end 2200*a* includes one or more grooves 2200*c* about which an assembly nut (not shown) can be twisted to hold the housing 2200 onto a tank wall of the transformer tank. In certain exemplary embodiments, a gasket (not shown) can be fitted about the first end 2200*a* of the housing 2200 for maintaining a mechanical seal between the tank wall and the housing 2200. The second end 2200*b* of the housing 2200 includes notches 2200*d* configured to receive snap features of a cover (not shown) of the tap changer.

A channel 2200*e* extends through the first end 2200*a* and the second end 2200*b* of the housing 2200. The channel 2200*e* is configured to receive a rotor (not shown) of the tap changer 1600. An interior profile 2200*f* of the housing 2200 corresponds to the rotor and the cover of the tap changer 1600.

The housing 2200 includes multiple pockets configured to receive dielectric fluid to increase dielectric capabilities and improve cooling of the switch contacts. For example, multiple pockets 2205*a* can encircle the switch 1600, between ribs 2200*g*. The ribs 2200*g* extend radially outward from the second end 2200*b* of the housing 2000 to an outside diameter of a round face 2000*h* of the housing 2200. For example, the housing 2000 can include about six pockets 2205*a*. The pockets are configured to be filled with dielectric fluid to cool the housing 2200 and the components contained therein, including the contacts (not shown), and to prevent dielectric breakdown. In certain exemplary embodiments, the dielectric fluid has greater dielectric strength and thermal conductivity than a plastic material, such as a polyethylene terephthalate (PET) polyester material, of the housing 2200. Thus, the pockets can increase dielectric capability of the switch 1600. This increased dielectric capability allows the switch 1600 to have a shorter length than traditional switches. For example, instead of using lengthy material to meet electric clearance and cooling goals, the switch 1600 can use shorter material with fluid-filled pockets.

With reference to FIGS. 18-22, when the housing 2200 is coupled to the cover 1610 (FIG. 21) via the snap features 1610*a*, the stationary contacts 1835-1840 are constrained by support members 1826*a* and 1827*a* and support ribs 2200*i* inside the housing 2200. The support members 1826*a* and 1827*a* and support ribs 2200*i* allow dielectric fluid to fill on both sides of the contacts 1835-1840, improving the cooling of the contacts 1835-1840.

In certain exemplary embodiments, the ribs 2200*i* are offset from the ribs 2200*g* so that a straight line path does not exist from the contacts 1835-1840 through both sets of ribs 2200*g* and 2200*i* to the transformer tank wall. The increased and tortuous path through the ribs 2200*g* and 2200*i* to the tank wall increases dielectric withstand and allows switch length to be reduced. For example, the length can be reduced because the ribs 2200*g* and 2200*i* force the electric path to travel the same "length" as in traditional switches, but portions of the path are disposed substantially perpendicular or angularly to the length of the switch.

Figure 23:
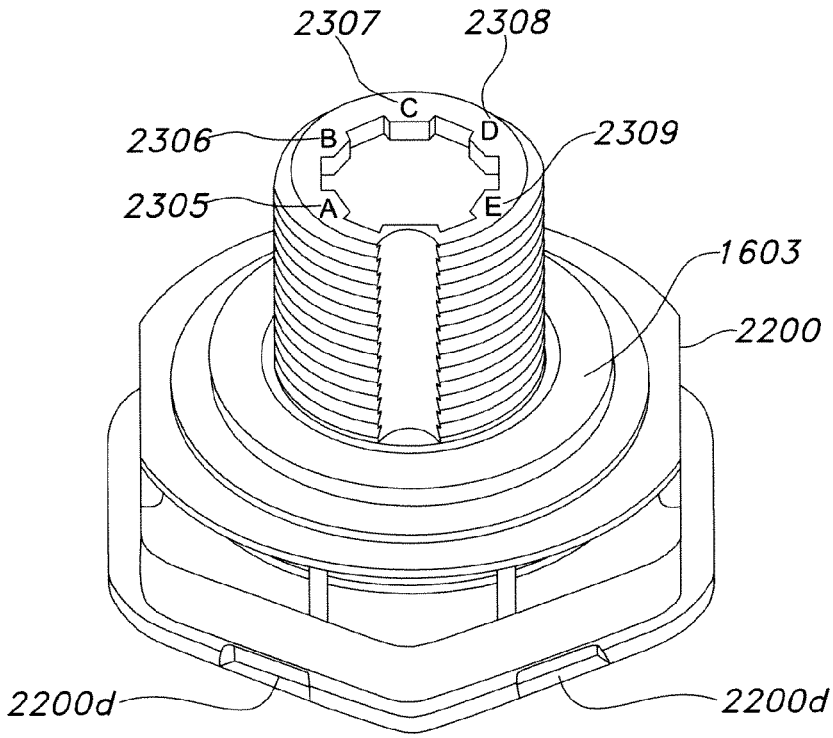
FIG. 23 is a perspective side view of a housing and a gasket aligned for assembly with stationary contacts, wires, a rotor, o-rings, and a movable contact assembly assembled within a cover of a tap changer, in accordance with certain exemplary embodiments.
Figure 23:
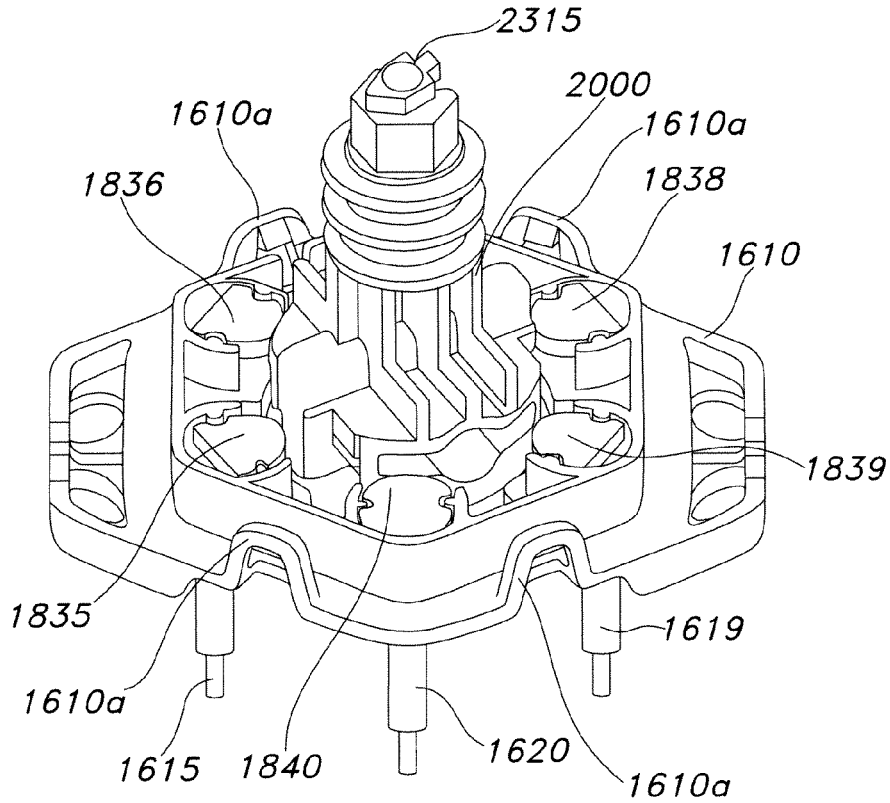
Figure 24:
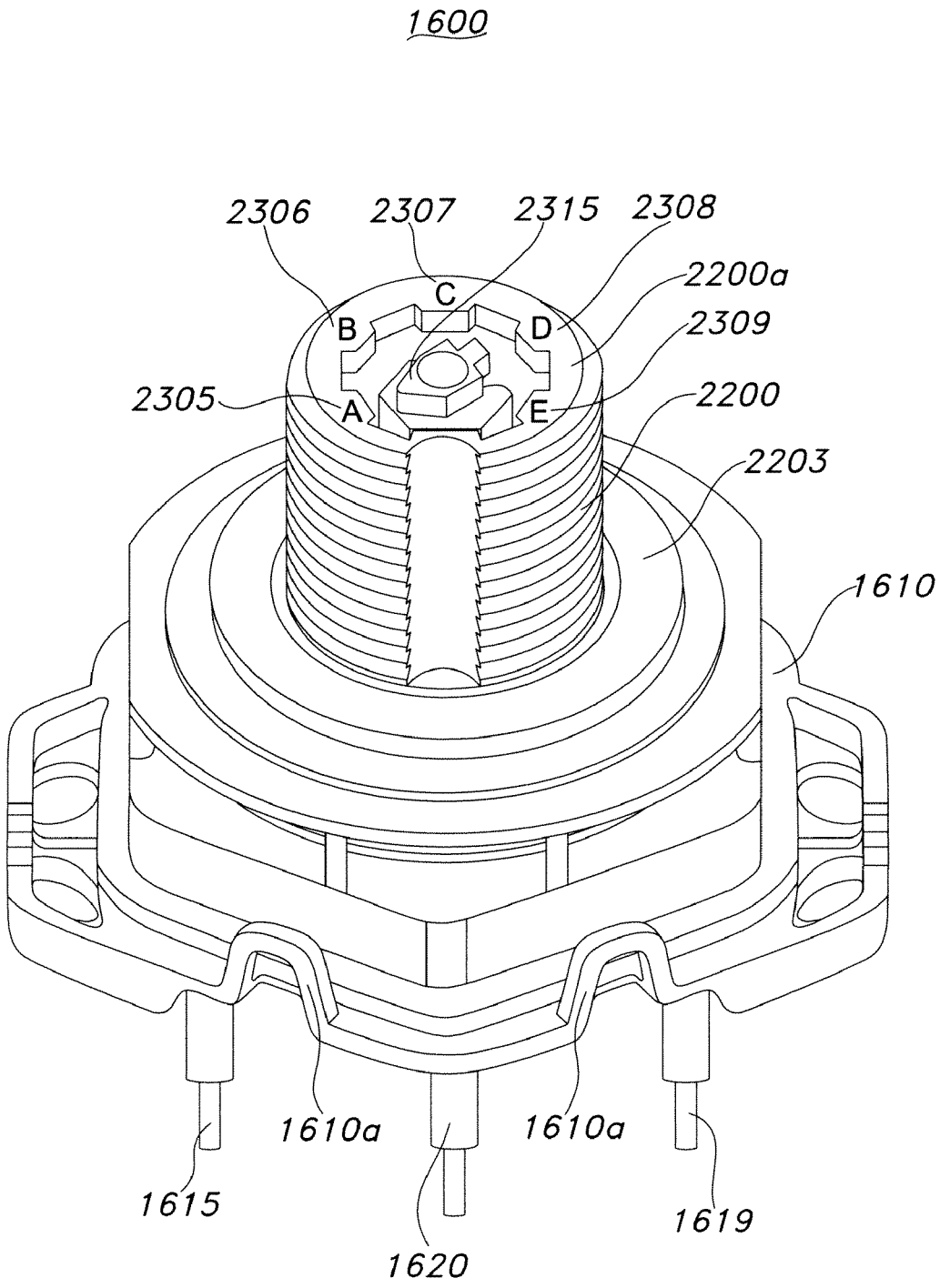
FIG. 24 is a perspective side view of a tap changer, in accordance with certain exemplary embodiments.

FIG. 23 is a perspective side view of the housing 2200 and the gasket 1603 aligned for assembly with the stationary contacts 1835-1840, wires 1615-1620, rotor 2000, and o-rings 2010 assembled within the cover 1610 of the tap changer, in accordance with certain exemplary embodiments. FIG. 24 is a perspective side view of an assembled tap changer 1600, in accordance with certain exemplary embodiments.

With reference to FIGS. 23-24, the housing 2200 of the assembled tap changer 1600 is disposed about the rotor 2000, the movable contact assembly 2005, the stationary contacts 1835-1840, and the cover 1610. The housing 2000 is attached to the cover 1610 via the snap features 1610*a* of the cover 1610. Each snap feature 1610*a* engages a corresponding notch 2200*d* of the housing 2200.

The first end 2200*a* of the housing 2200 includes labels 2305-2309, which indicate the electrical configuration and corresponding voltage setting of the transformer being controlled by the tap changer. For example, each of the labels 2305-2309 can correspond to a different transformer turn ratio. Rotation of the rotor 2000 within the housing 2200 causes an indicator 2315 of the rotor 2000 to point to one of the labels 2305-2309. Thus, an operator viewing the indicator 2315 can determine the configuration of the windings without physically inspecting the windings or the movable contact-stationary contact pairings within the tap changer 1600. In certain exemplary embodiments, the operator can rotate a handle (not shown) coupled to the rotor 2000 to change the turn ratio. In certain exemplary embodiments, the stationary contacts 1835-1840 and the wires that are connected to the contacts 1835-1840 are identified by labels 3005 (shown on FIG. 16) on the outside of the cover 1610 of the switch. These labels 3005 can aid an operator assembling the switch to correctly wire the switch with respect to the labels 2305-2309 on the front of the housing 2200.

Figure 25:
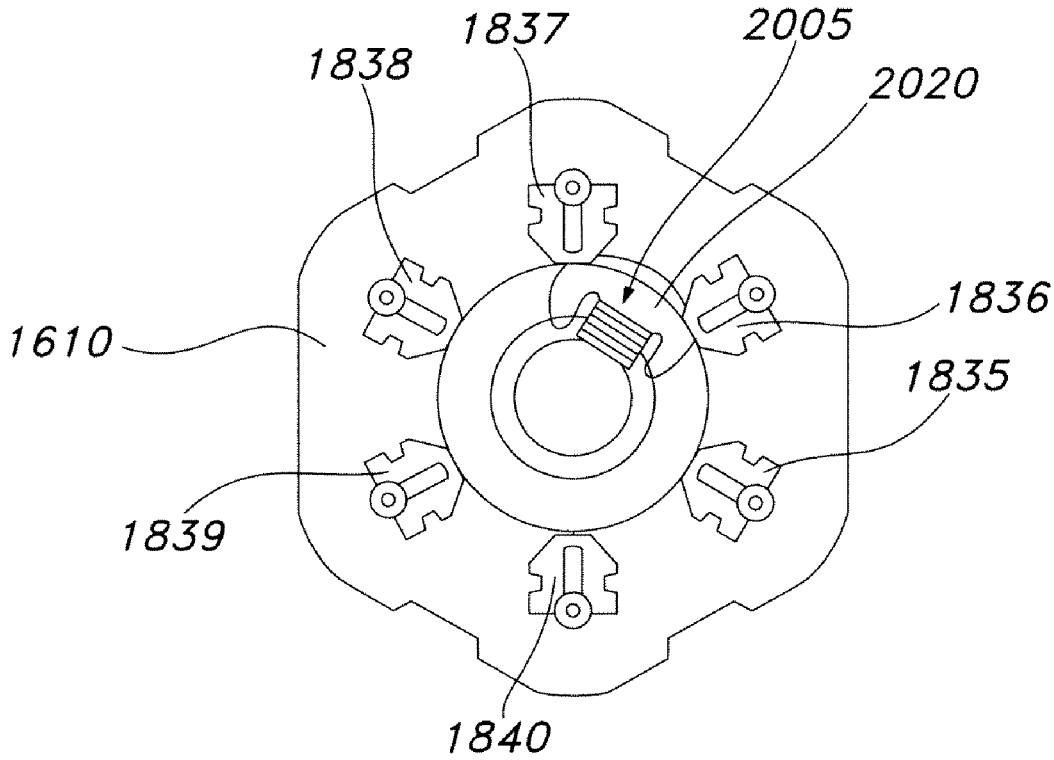
FIG. 25 is an elevational top view of a movable contact assembly in a first position relative to stationary contacts assembled within a cover of a tap changer, in accordance with certain exemplary embodiments.
Figure 26:
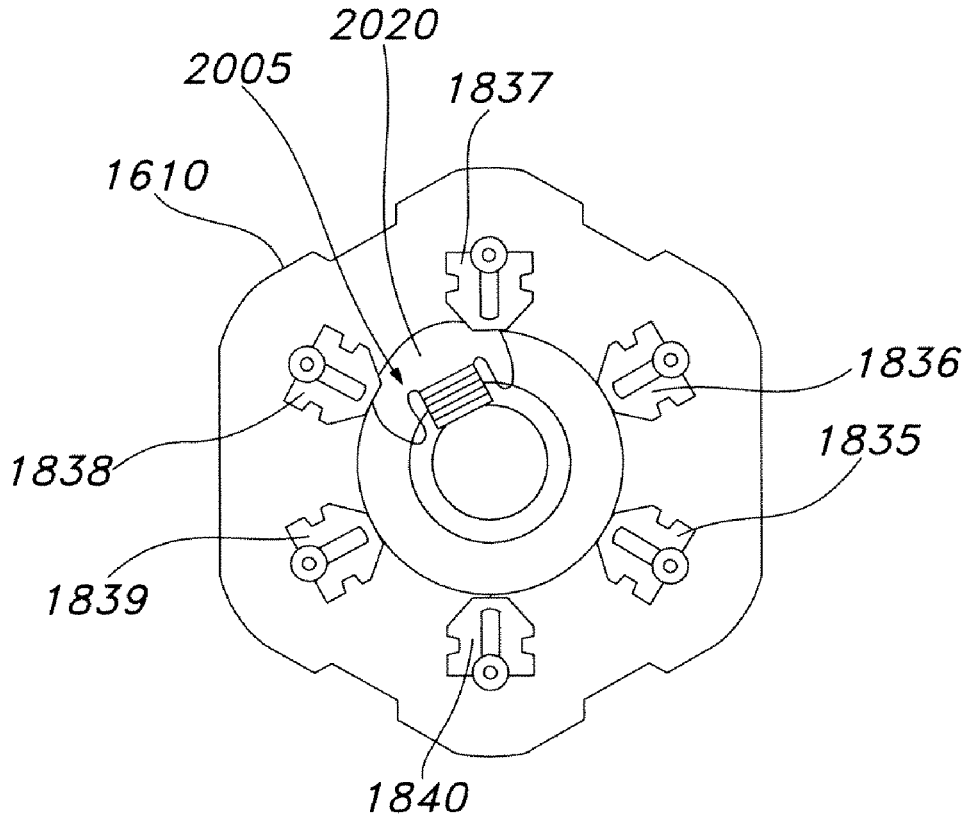
FIG. 26 is an elevational top view of a movable contact assembly in a second position relative to stationary contacts assembled within a cover of a tap changer, in accordance with certain exemplary embodiments.

FIG. 25 is an elevational bottom view of the movable contact assembly 2005 in a first position relative to the stationary contacts 1835-1840 assembled within the cover 1610 of the tap changer, in accordance with certain exemplary embodiments. FIG. 26 is an elevational bottom view of the movable contact assembly 2005 in a second position relative to the stationary contacts 1835-1840.

Each position corresponds to a different electrical configuration of the transformer being controlled by the tap changer. For example, each position can correspond to a different transformer turn ratio. In the first position, the movable contact 2020 is electrically coupled to stationary contacts 1836 and 1837. In the second position, the movable contact 2020 is electrically coupled to stationary contacts 1837 and 1838.

Figure 27:
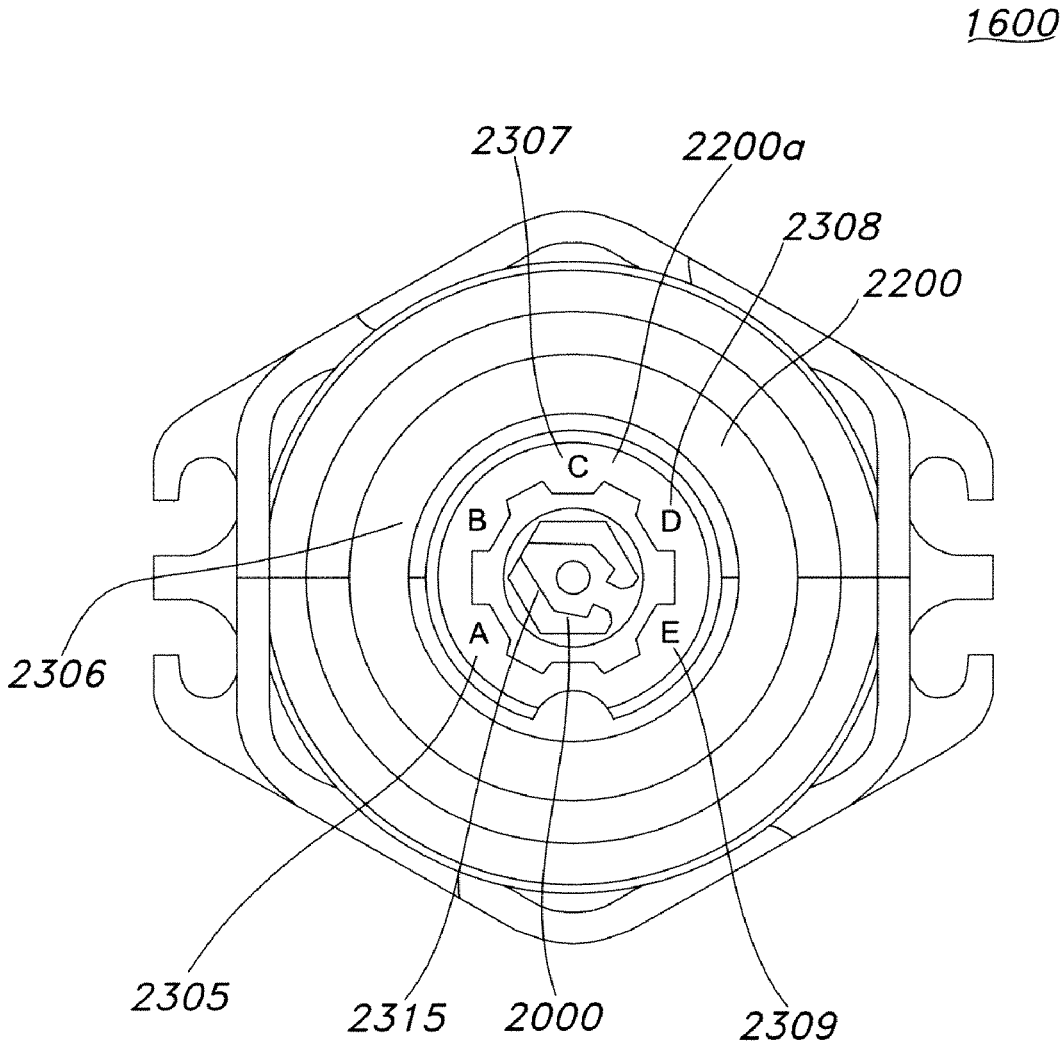
FIG. 27 is an elevational top view of a tap changer in a first position, in accordance with certain exemplary embodiments.
Figure 28:
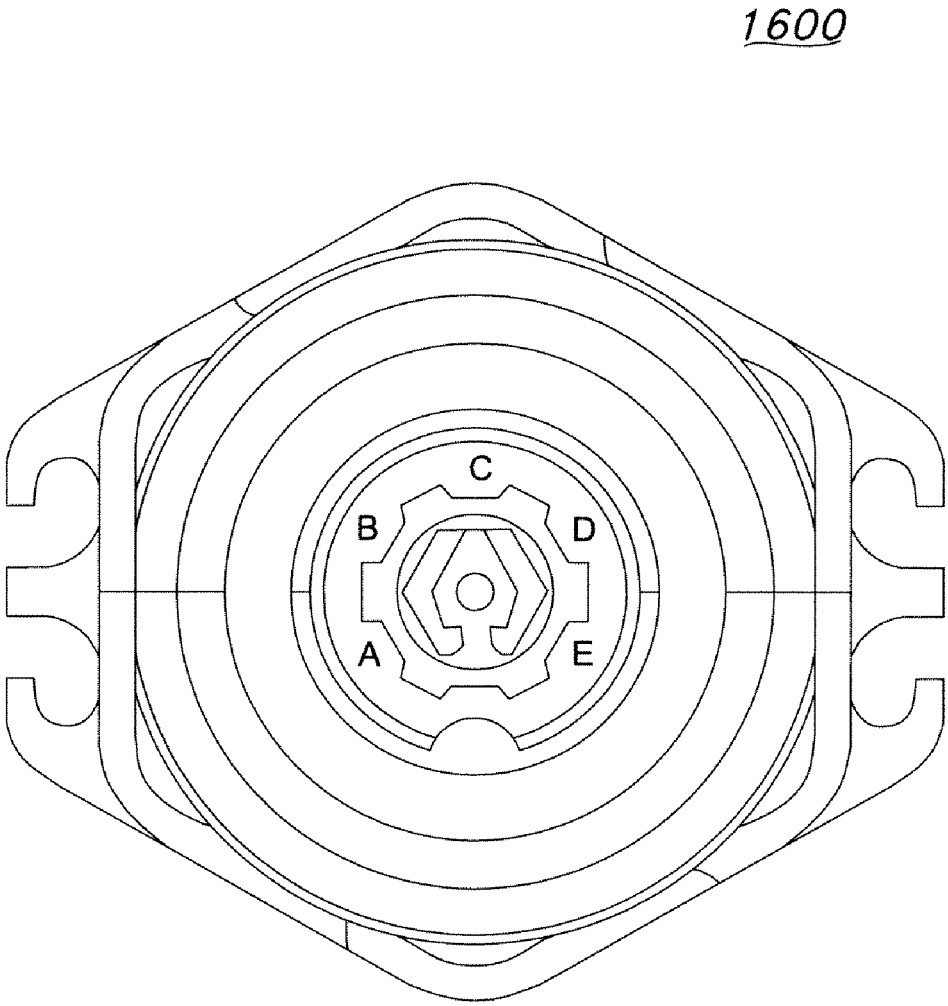
FIG. 28 is an elevational top view of a tap changer in a second position, in accordance with certain exemplary embodiments.

FIG. 27 is an elevational top view of the tap changer 1600 in a first position, in accordance with certain exemplary embodiments. FIG. 28 is an elevational top view of the tap changer 1600 in a second position, in accordance with certain exemplary embodiments. With reference to FIGS. 25-28, the first end 2200*a* of the housing 2200 of the tap changer 1600 includes labels 2305-2309, which indicate the position of the movable contact 2005 relative to the stationary contacts 1835-1840. Label "A" 2005 corresponds to the first position of the movable contact assembly 2305 in FIG. 25, and label "B" 2306 corresponds to the second position of the movable contact assembly 2005 in FIG. 26. Similarly, labels "C" 2307, "D" 2308, and "E" 2309 correspond to other positions of the movable contact assembly 2005 relative to the stationary contacts 1835-1840.

For example, in the position corresponding to label "C" 2307, the movable contact 2020 can be electrically coupled to stationary contacts 1838 and 1839; in the position corresponding to label "D" 2308, the movable contact 2020 can be electrically coupled to stationary contacts 1839 and 1840; and in the position corresponding to label "E" 2309, the movable contact 2020 can be electrically coupled to stationary contacts 1840 and 1835. Rotation of the rotor 2000 within the housing 2200 causes the indicator 2315 of the rotor 2000 to point to one of the labels 2305-2309. Thus, an operator viewing the indicator 2315 can determine the configuration of the windings without physically inspecting the windings or the movable contact-stationary contact pairings within the tap changer 1600. In certain exemplary embodiments, the operator can rotate a handle (not shown) coupled to the rotor 2000 to change the position of the movable contact 2020 relative to the stationary contacts 1835-1840.

Figure 29:
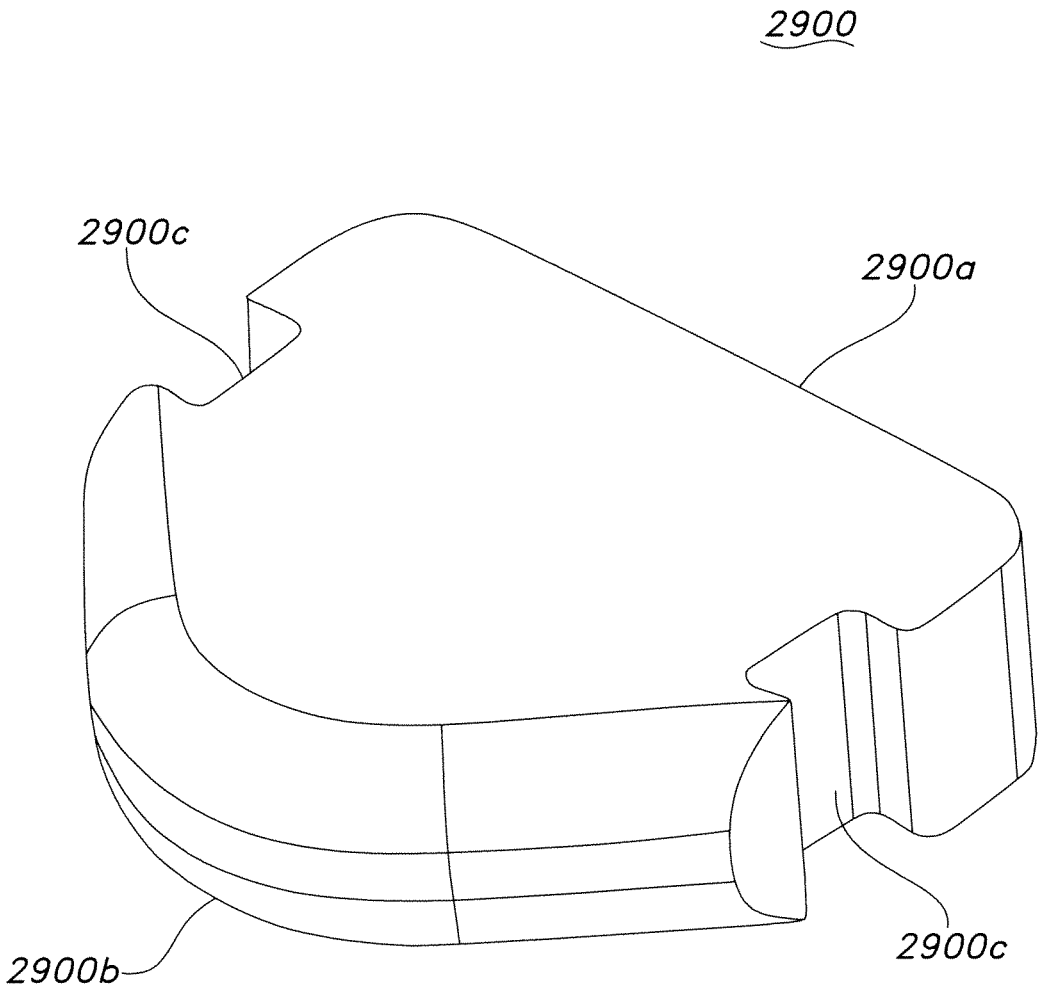
FIG. 29 is a perspective view of a "single button" stationary contact of a transformer switch, in accordance with certain alternative exemplary embodiments.

FIG. 29 is a perspective view of a "single button" stationary contact 2900 of a transformer switch (not shown), in accordance with certain alternative exemplary embodiments. The contact 2900 comprises an electrically conductive material, such as copper. The contact 2900 includes a substantially flat base member 2900*a* and substantially pointed top member 2900*b*. A pair of notches 2900*c* are disposed on opposite sides of the contact 2900, between the base member 2900*a* and the top member 2900*b*. Each notch 2900*c* is configured to slidably engage a corresponding protrusion of a switch cover (not shown) substantially as described above. The pointed shape of the contact 2900 can increase electrical clearance between neighboring contacts within the switch, as compared to the substantially semi-circular shaped contacts described previously, by increasing the distance between outer edges of the contacts.

Figure 30:
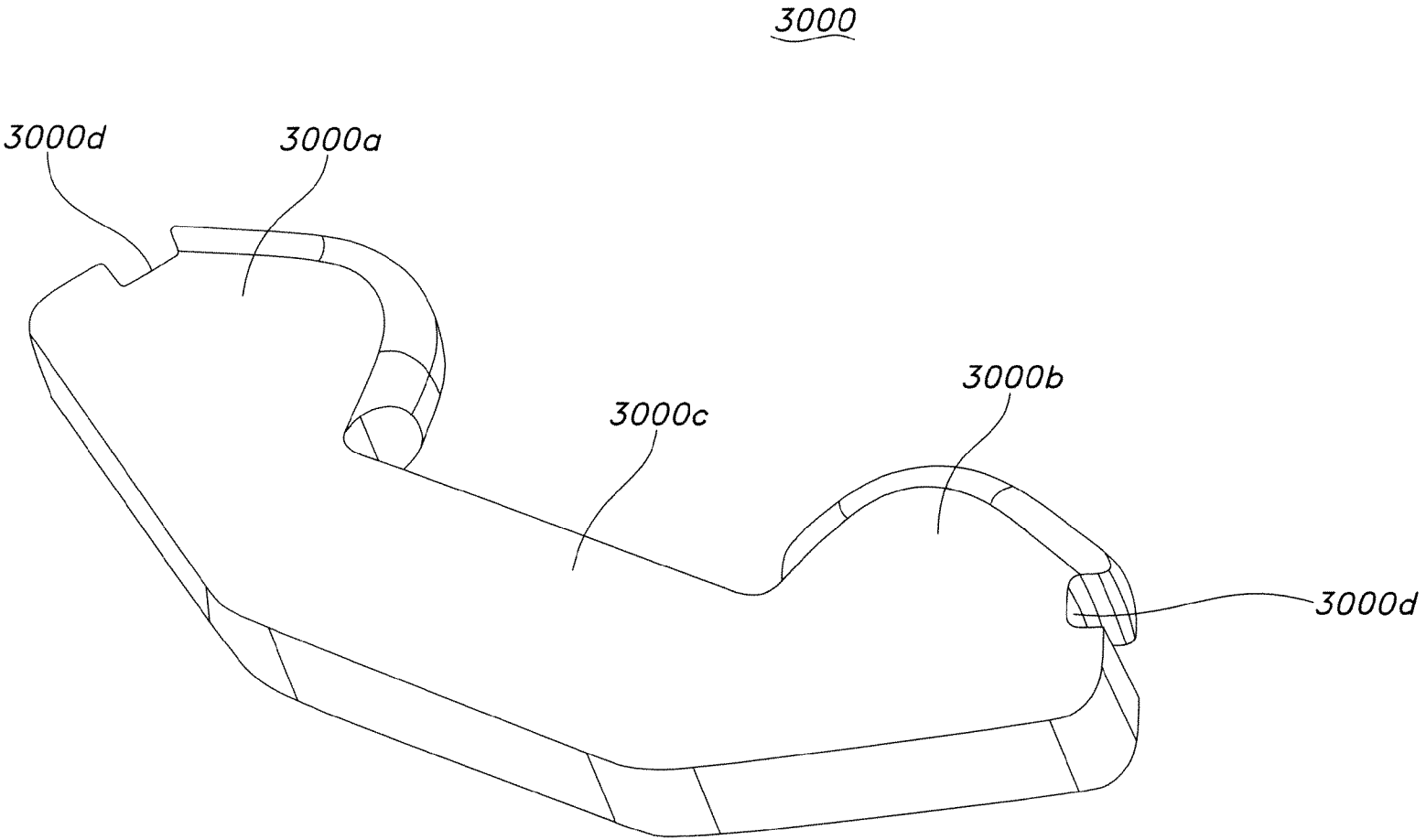
FIG. 30 is a perspective view of a "double button" stationary contact of a transformer switch, in accordance with certain alternative exemplary embodiments.

FIG. 30 is a perspective view of a "double button" stationary contact 3000 of a transformer switch (not shown), in accordance with certain alternative exemplary embodiments. The stationary contact 3000 includes two, substantially pointed members 3000*a*-3000*b* disposed on opposite sides of an elongated member 3000*c*. Each of the members 3000*a*, 3000*b* is offset from the elongated member 3000*c* such that a non-zero, acute angle exists between a bottom edge of each member 3000*a*, 3000*b* and a bottom edge of the elongated member 3000*c*. This geometry, coupled with the relative spacing of the other contacts within the transformer switch, allows smooth rotation and selective coupling of movable and stationary contacts of the switch during an operation of the switch. For example, this geometry allows the movable contacts to be in line with one another, having an incident angle between their axes of force to be 180 degrees. Each of members 3000*a* and 3000*b* includes a notch 3000*d* configured to slidably engage a corresponding protrusion of a switch cover substantially as described above. The pointed shapes of the members 2900*a*-2900*b* can increase electrical clearance between neighboring contacts within the switch, as compared to the substantially semi-circular shaped members of the double button contact described previously with reference to FIG. 5, by increasing the distance between outer edges of the contacts.

Figure 31:
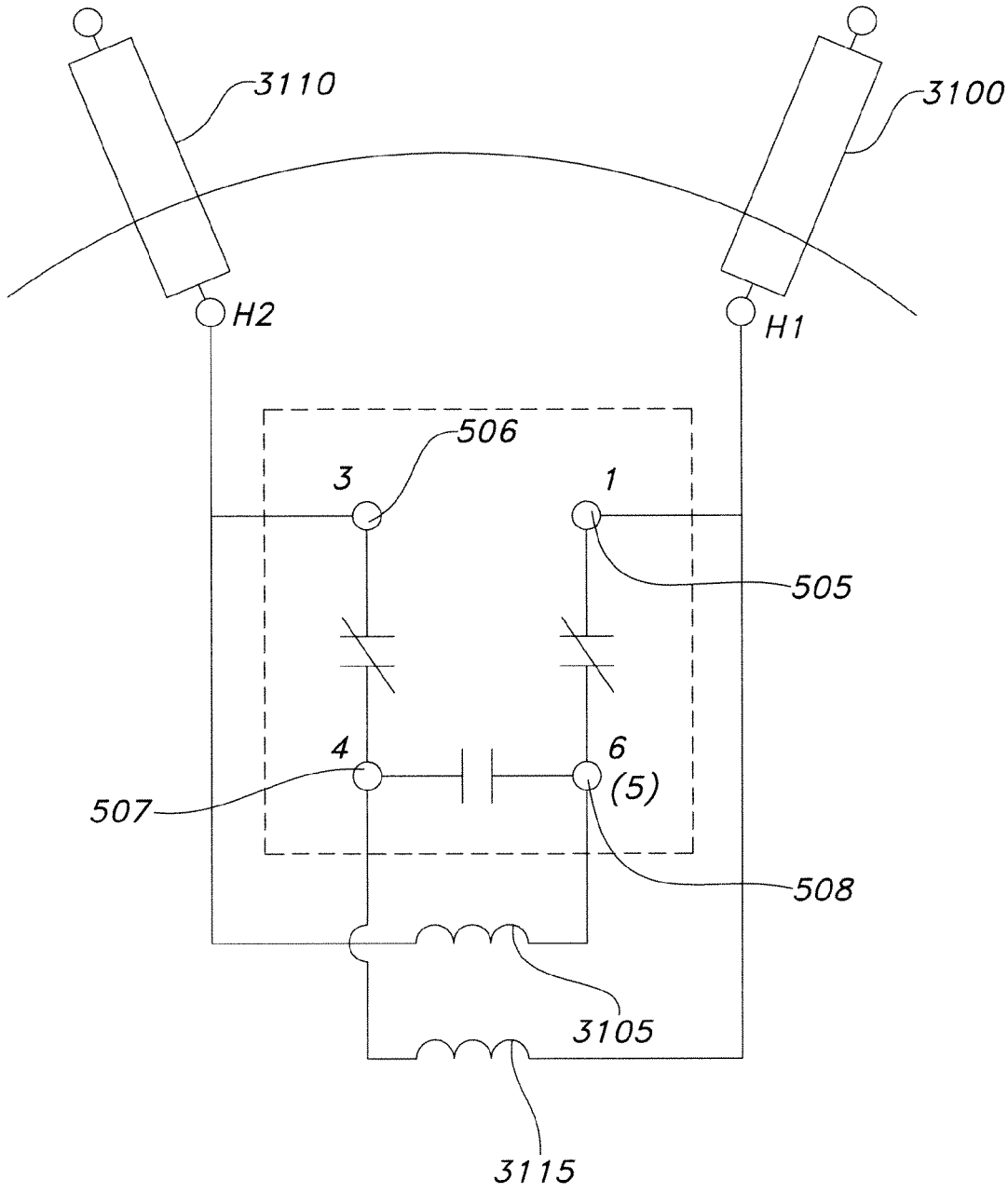
FIG. 31 is a circuit diagram of a dual voltage switch in an operating position corresponding to an in-parallel configuration of a transformer, in accordance with certain exemplary embodiments.

FIG. 31 is a circuit diagram of a dual voltage switch in an operating position corresponding to an in-parallel configuration of a transformer, in accordance with certain exemplary embodiments. In the in-parallel configuration, current flows from a first bushing 3100, through stationary contact 505, through stationary contact 508, through a transformer winding 3105, and to a second bushing 3110. Current also flows from the first bushing 3100, through a second transformer winding 3115, through stationary contact 507, through stationary contact 506, and to the second bushing 3110.

Figure 32:
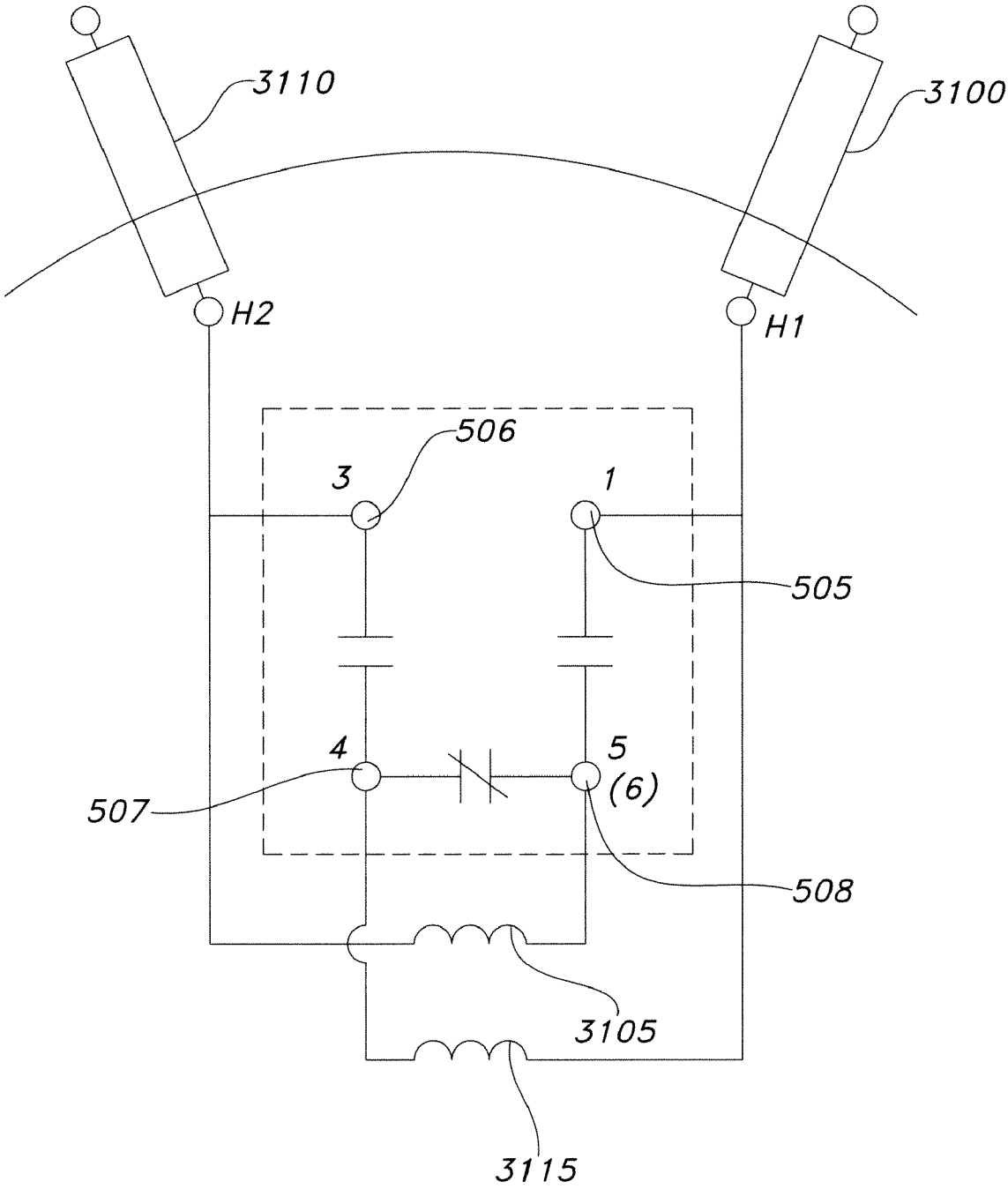
FIG. 32 is a circuit diagram of a dual voltage switch in an operating position corresponding to an in-series configuration of a transformer, in accordance with certain exemplary embodiments.

FIG. 32 is a circuit diagram of a dual voltage switch in an operating position corresponding to an in-series configuration of a transformer, in accordance with certain exemplary embodiments. In the in-series configuration, current flows from the first bushing 3100, through the second transformer winding 3115, through stationary contact 507, through stationary contact 508, through the first transformer winding 3105, and to the second bushing 3110.

Figure 33:
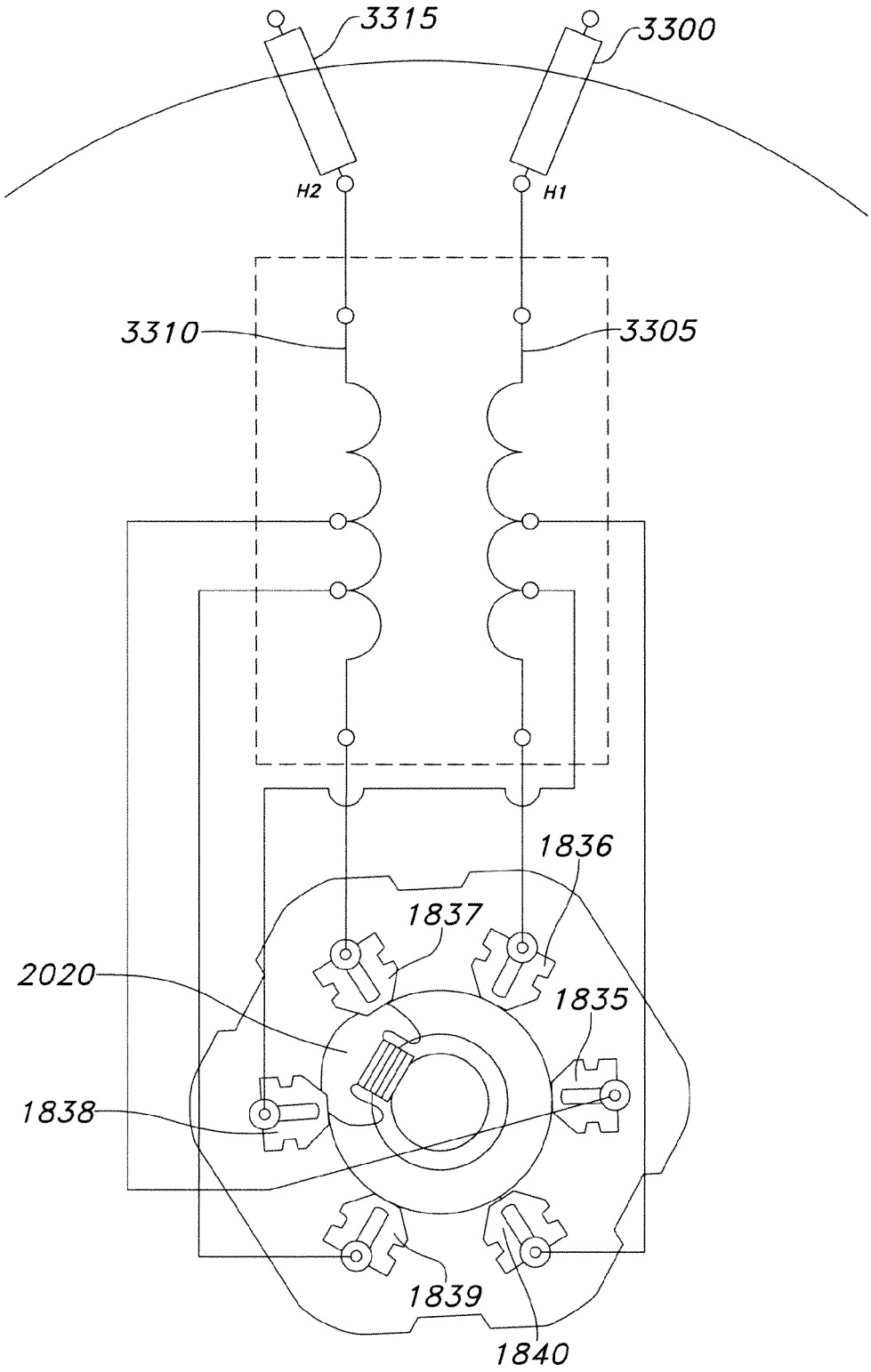
FIG. 33 is a circuit diagram of a tap changer switch in a transformer, in accordance with certain exemplary embodiments.

FIG. 33 is a circuit diagram of a tap changer switch in a transformer, in accordance with certain exemplary embodiments. A different circuit configuration exists for each position of the movable contact 2020 relative to the stationary contacts 1835-1840. For example, when the movable contact 2020 straddles stationary contacts 1836 and 1837, current flows from the first bushing 3300, through all turns of the first transformer winding 3305, through stationary contact 1836, through movable contact 2020, through stationary contact 1837, through all turns of the second transformer winding 3310, and to the second bushing 3315. When the movable contact 2020 straddles stationary contacts 1837 and 1838, current flows from a first bushing 3300, through three turns of a first transformer winding 3305, through stationary contact 1838, through the movable contact 2020, through the stationary contact 1837, through all turns of a second transformer winding 3310, and to the second bushing 3315. When the movable contact 2020 straddles stationary contacts 1838 and 1839, current flows from the first bushing 3300, through three turns of the first transformer winding 3305, through stationary contact 1838, through movable contact 2020, through stationary contact 1839, through three turns of the second transformer winding 3310, and to the second bushing 3315. A person of ordinary skill in the art having the benefit of this disclosure will recognize that many other circuit configurations are suitable.

When the movable contact 2020 straddles stationary contacts 1839 and 1840, current flows from the first bushing 3300, through two turns of the first transformer winding 3305, through stationary contact 1840, through movable contact 2020, through stationary contact 1839, through three turns of the second transformer winding 3310, and to the second bushing 3315. When the movable contact 2020 straddles stationary contacts 1840 and 1835, current flows from the first bushing 3300, through two turns of the first transformer winding 3305, through stationary contact 1840, through movable contact 2020, through stationary contact 1835, through two turns of the second transformer winding 3310, and to the second bushing 3315.

Figure 34:
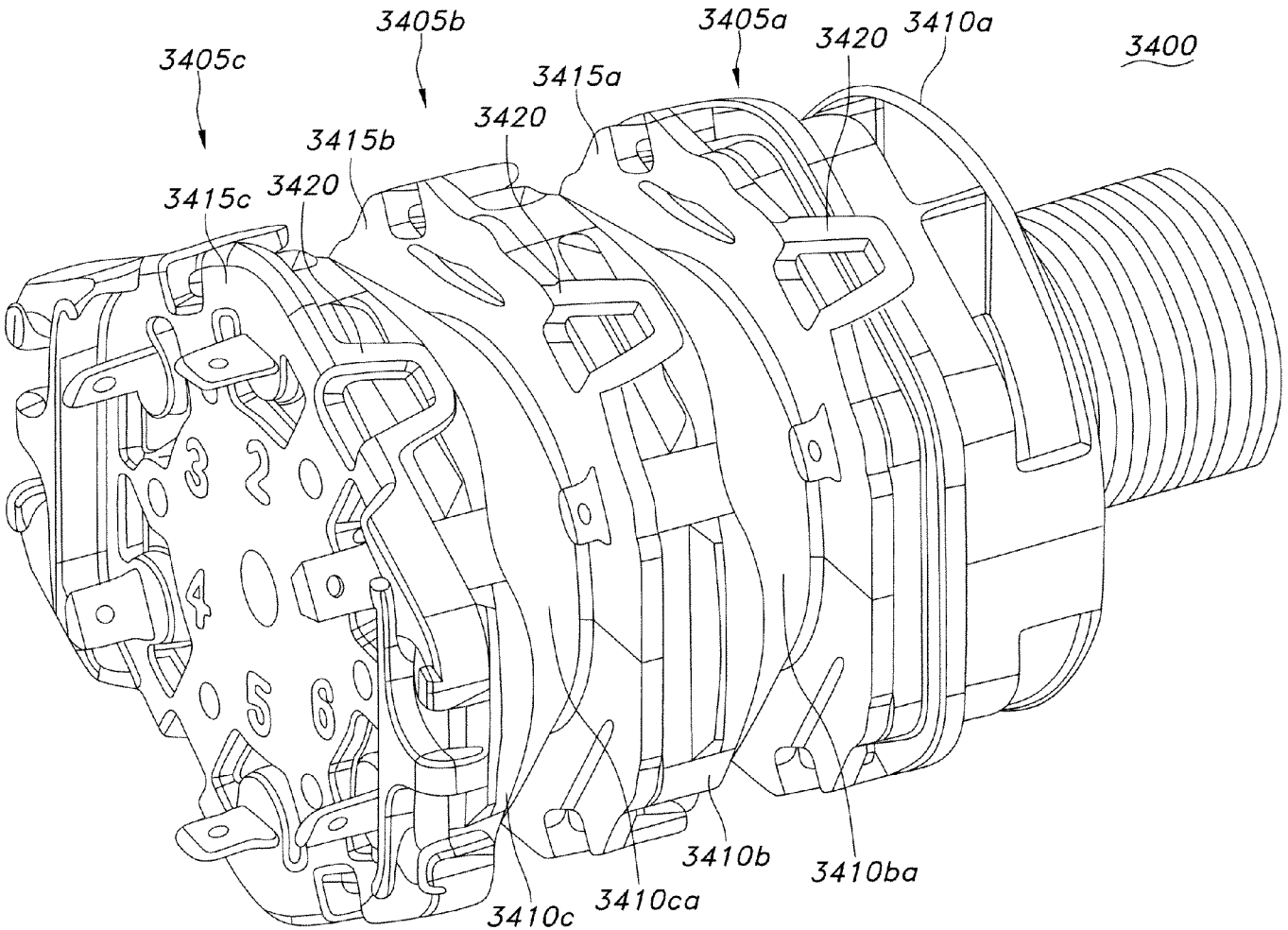
FIG. 34 is perspective view of a tap changer, in accordance with certain alternative exemplary embodiments.
Figure 35:
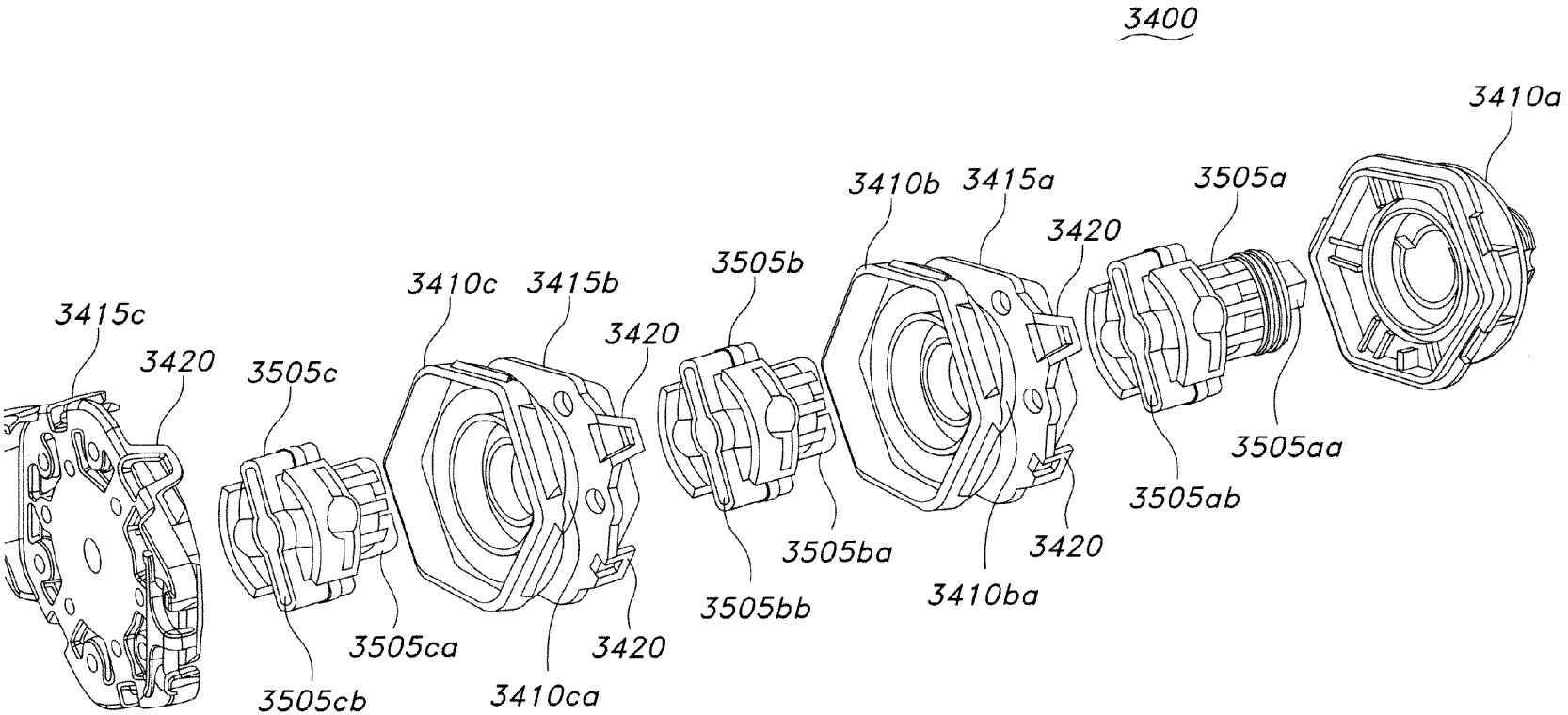
FIG. 35 is an exploded view of the tap changer of FIG. 34 with certain elements removed for clarity, in accordance with certain alternative exemplary embodiments.

FIG. 34 is a perspective view of a tap changer 3400, in accordance with certain alternative exemplary embodiments. FIG. 35 is an exploded view of the tap changer 3400 with certain elements removed for clarity, in accordance with certain alternative exemplary embodiments. The tap changer 3400 is substantially similar to the tap changer 1600 discussed previously with reference to FIGS. 16-28, except that the tap changer 3400 includes three pairs 3405*a*-3405*c* of housings 3410*a*-3410*c* and covers 3415*a*-3415*c*. The first housing 3410*a* and the third cover 3415*c* are substantially similar to the housing 1614 and cover 1610, respectively, of the tap changer 1600.

Each of the housings 3410*a*-3410*c* is removably coupled to a corresponding one of the covers 3415*a*-3415*c* via one or more snap features 3420 of the cover 3415*a*-3415*c*. In certain alternative exemplary embodiments, one or more of the housings 3410*a*-3410*c* can include the snap features 3420. Each housing 3410*a*-3410*c* and cover 3415*a*-3415*c* is at least partially molded from a non-conductive material, such as a non-conductive plastic.

The cover 3415*a* and housing 3410*b* are integral with one another. Similarly, the cover 3415*b* and housing 3410*c* are integral with one another. Cover 3415*a* (along with integral housing 3410*b*) is snapped to housing 3410*a;* cover 3415*b* (along with integral housing 3410*c*) is snapped to housing 3410*b;* and cover 3415*c* is snapped to housing 3410*c*. Each of the housings 3410*b* and 3410*c* has an angled or curved upper end 3410*ba* and 3410*ca*, respectively, that provides clearance for wires (not shown) to engage stationary contacts (not shown) within corresponding covers 3415*a* and 3415*b*, respectively.

Multiple rotors 3505 extend along a central axis of the tap changer 3400, with each rotor 3505 being disposed between a corresponding one of the housing 3410 and cover 3415 pairs 3405. The rotors 3505 are configured to engage one another so that movement of one rotor 3505 causes similar movement of the other rotors 3505. For example, each rotor 3505 can include a notch 3505*aa*, 3505*ba*, 3505*ca* and/or protrusion 3505*ab*, 3505*bb*, 3505*cb* configured to be engaged by a corresponding protrusion 3505*aa,* 3505*ba*, 3505*ca* and/or notch 3505*ab*, 3505*bb*, 3505*cb* of a neighboring rotor 3505. This arrangement allows the rotors 3505 and movable contacts (not shown) coupled thereto to rotate substantially co-axially along the central axis of the tap changer 3400. In certain exemplary embodiments, an operator can rotate a handle (not shown) coupled to one of the rotors 3505, such as a rotor 3505*a* disposed within the housing 3410*a* and cover 3415*a* pair 3405*a*, to rotate the rotors 3505*a*, 3505*b*, and 3505*c* within the housing and cover pairs 3405*a*-3405*c*.

The multiple housing and cover pairs 3405*a*-3405*c* may employ many different configurations. For example, each housing and cover pair 3405*a*-3405*c* may be electrically coupled to a different phase of three-phrase power in a transformer. Although FIGS. 34 and 35 illustrate a tap changer 3400 with three housing and cover pairs 3405*a*-3405*c*, a person of ordinary skill in the art having the benefit of this disclosure will recognize that any number of housing and cover assemblies may be included. In addition, other types of transformer switches, including a dual voltage switch, also may include multiple housing and cover pairs. For example, a dual voltage switch may include two or more housing and cover pairs in a three-phase power configuration, a 2:1+ turn ratio configuration, a 2:1− turn ratio configuration, and/or a 3:1 turn ratio configuration.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A transformer switch, comprising:

a first housing;

a plurality of second housings;

a plurality of first covers, each of the plurality of first covers formed integrally with respective ones of the plurality of second housings;

a second cover;

the first housing, the plurality of second housings, the plurality of first covers and the second cover are formed from at least one non-conductive material;

the first housing is removably coupled to a one of the plurality of first covers;

remaining ones of the plurality of first covers are removably coupled to respective ones of the plurality of second housings;

the second cover is removably coupled to one of the plurality of second, housings not coupled to one of the plurality of first covers;

each of the plurality of first covers and the second cover comprise:

a base member;

a wall member extending from the surface of the base member and defining an interior space of the cover; and a plurality of pockets extending from the wall member, within the interior space of the cover, a plurality of stationary electric contacts each being disposed within one of the pockets of the cover;

a plurality of rotors, each of the plurality of rotors having at least one movable contact coupled to the rotor and configured to be selectively electrically coupled to at least two of the plurality of stationary electric contacts in respective ones of the plurality of first covers and the second cover.

2. The transformer switch of claim 1, wherein a snap feature removably couples the first housing to the one of the plurality of first covers.

3. The transformer switch of claim 1, wherein snap features removably couple the remaining ones of the plurality of first covers to the respective ones of the plurality of second housings.

4. The transformer switch of claim 1, wherein a snap feature removably couples the second cover to the one of the plurality of second housings not coupled to one of the plurality of first covers.

5. The transformer switch of claim 1, wherein the first housing and the plurality of second housings have openings for dielectric fluid to flow therein, thereby allowing an increase in dielectric capabilities and improved cooling of the transformer switch.

6. A transformer switch, comprising:

a first housing;

at least one second housing;

at least one first cover, the at least one first cover is formed integrally with a respective one of the at least one second housing;

a second cover;

the first housing, the at least one second housing, the at least one first cover and the second cover are formed from at least one non-conductive material;

the first housing is removably coupled to a respective one of the at least one first cover;

any remaining one of the at least one first cover is removably coupled to a respective one of the at least one second housing;

the second cover is removably coupled to a one of the at least one second housing not coupled to one of the at least one first cover;

each one of the at least one first cover and the second cover comprise:

a base member;

a wall member extending from the surface of the base member and defining an interior space of the cover; and a plurality of pockets extending from the wall member, within the interior space of the cover, a plurality of stationary electric contacts each being disposed within one of the pockets of the cover;

a plurality of rotors, each of the plurality of rotors having at least one movable contact coupled to the rotor and configured to be selectively electrically coupled to at least two of the plurality of stationary electric contacts in respective ones of the at least one first cover and the second cover.

7. The transformer switch of claim 6, wherein a snap feature removably couples the first housing to the one of the plurality of first covers.

8. The transformer switch of claim 6, wherein snap features removably couple the remaining ones of the plurality of first covers to the respective ones of the plurality of second housings.

9. The transformer switch of claim 6, wherein a snap feature removably couples the second cover to the one of the plurality of second housings not coupled to one of the plurality of first covers.

10. The transformer switch of claim 6, wherein the first housing and the plurality of second housings have openings for dielectric fluid to flow therein, thereby allowing an increase in dielectric capabilities and improved cooling of the transformer switch.

11. A dual voltage transformer switch, comprising:

a first housing;

a plurality of second housings;

a plurality of first covers, each of the plurality of first covers formed integrally with respective ones of the plurality of second housings;

a second cover;

the first housing, the plurality of second housings, the plurality of first covers and the second cover are formed from at least one non-conductive material;

the first housing is removably coupled to a one of the plurality of first covers;

remaining ones of the plurality of first covers are removably coupled to respective ones of the plurality of second housings;

the second cover is removably coupled to one of the plurality of second housings not coupled to one of the plurality of first covers;

each of the plurality of first covers and the second cover comprise:

a base member;

a wall member extending from the surface of the base member and defining an interior space of the cover; and a plurality of pockets extending from the wall member, within the interior space of the cover, a plurality of stationary electric contacts each being disposed within one of the pockets of the cover;

a plurality of rotors, each of the plurality of rotors having at least one movable contact coupled to the rotor and configured to be selectively electrically coupled to at least two of the plurality of stationary electric contacts in respective ones of the plurality of first covers and the second cover, wherein the plurality of rotors are movable between either one of two positions.

12. The transformer switch of claim 11, wherein a snap feature removably couples the first housing to the one of the plurality of first covers.

13. The transformer switch of claim 11, wherein snap features removably couple the remaining ones of the plurality of first covers to the respective ones of the plurality of second housings.

14. The transformer switch of claim 11, wherein a snap feature removably couples the second cover to the one of the plurality of second housings not coupled to one of the plurality of first covers.

15. The transformer switch of claim 11, wherein the first housing and the plurality of second housings have openings for dielectric fluid to flow therein, thereby allowing an increase in dielectric capabilities and improved cooling of the transformer switch.

16. A multi-tap voltage transformer switch, comprising:

a first housing;

a plurality of second housings;

a plurality of first covers, each of the plurality of first covers formed, integrally with respective ones of the plurality of second housings;

a second cover;

the first housing, the plurality of second housings, the plurality of first covers and the second cover are formed from at least one non-conductive material;

the first housing is removably coupled to a one of the plurality of first covers;

remaining ones of the plurality of first covers are removably coupled to respective ones of the plurality of second housings;

the second cover is removably coupled to one of the plurality of second housings not coupled to one of the plurality of first covers;

each of the plurality of first covers and the second cover comprise:

a base member;

a wall member extending from the surface of the base member and defining an interior space of the cover; and a plurality of pockets extending from the wall member, within the interior space of the cover, a plurality of stationary electric contacts each being disposed within one of the pockets of the cover;

a plurality of rotors, each of the plurality of rotors having at least one movable contact coupled to the rotor and configured to be selectively electrically coupled to at least two of the plurality of stationary electric contacts in respective ones of the plurality of first covers and the second cover, wherein the plurality of rotors are movable between each one of a plurality of positions.

17. The transformer switch of claim. 16, wherein a snap feature removably couples the first housing to the one of the plurality of first covers.

18. The transformer switch of claim 16, wherein snap features removably couple the remaining ones of the plurality of first covers to the respective ones of the plurality of second housings.

19. The transformer switch of claim 16, wherein a snap feature removably couples the second cover to the one of the plurality of second housings not coupled to one of the plurality of first covers.

20. The transformer switch of claim 16, wherein the first housing and the plurality of second housings have openings for dielectric fluid to flow therein, thereby allowing an increase in dielectric capabilities and improved cooling of the transformer switch.

* * * * *